US007304278B2

(12) United States Patent
Kanzaki et al.

(10) Patent No.: US 7,304,278 B2
(45) Date of Patent: Dec. 4, 2007

(54) STEAM GENERATION FUNCTION-EQUIPPED HIGH-FREQUENCY HEATING DEVICE

(75) Inventors: Kouji Kanzaki, Yamatokoriyama (JP); Yuji Hayakawa, Shiki-gun (JP); Takahiko Yamasaki, Nara (JP); Yasuhisa Mori, Kitakaturagi-gun (JP); Takayuki Akashi, Ikoma (JP); Hiroshi Kawai, Ikoma-gun (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 63 days.

(21) Appl. No.: 10/548,479

(22) PCT Filed: Mar. 11, 2004

(86) PCT No.: PCT/JP2004/003187

§ 371 (c)(1),
(2), (4) Date: Sep. 8, 2005

(87) PCT Pub. No.: WO2004/081455

PCT Pub. Date: Sep. 23, 2004

(65) Prior Publication Data

US 2006/0088301 A1 Apr. 27, 2006

(30) Foreign Application Priority Data

Mar. 13, 2003 (JP) ..... 2003-068222
May 21, 2003 (JP) ..... 2003-143014
Aug. 7, 2003 (JP) ..... 2003-288780

(51) Int. Cl.
*H05B 6/80* (2006.01)

(52) U.S. Cl. ..... 219/682; 219/687; 219/403

(58) Field of Classification Search ..... 219/682, 219/686, 687, 401, 403, 385, 386, 731, 772, 219/683, 710–712, 716, 718, 684, 685, 756–757; 122/DIG. 11, 30, 31.1; 126/21 A, 20.1, 20.2, 126/369; 392/386, 394, 396, 397, 480; 99/330, 99/331, 451, 467, 325
See application file for complete search history.

(56) References Cited

U.S. PATENT DOCUMENTS 5,492,602 A * 2/1996 Vogelman et al. ..... 202/181

(Continued)

FOREIGN PATENT DOCUMENTS

JP 54-10460 1/1979

(Continued)

OTHER PUBLICATIONS

Japanese Search Report dated Jun. 8, 2007.

*Primary Examiner*—Quang Van
(74) *Attorney, Agent, or Firm*—Pearne & Gordon LLP

(57) ABSTRACT

An object of the present invention is to provide a high frequency heating apparatus having a steam generating function in which a time required for evaporation of dropped water can be remarkably increased when water is dropped onto an evaporation tray and the heating efficiency is high.

The high frequency heating apparatus has a steam generating function that includes a high frequency generator and a steam generator that includes an evaporation tray provided on the bottom surface of a heating chamber in which a heating target is mounted and a heater device for heating the evaporation tray to generate steam in the heating chamber, wherein the heater device is constructed as a heater device (11) having a sheathed heater (113) embedded in an aluminum die cast (111), and the heater device is directly attached to the back side of the evaporation tray (22).

25 Claims, 27 Drawing Sheets

U.S. PATENT DOCUMENTS

| | | | | |
|---|---|---|---|---|
| 5,680,810 | A * | 10/1997 | Sham | 99/330 |
| 6,031,969 | A * | 2/2000 | Burr et al. | 392/404 |
| 6,891,133 | B2 * | 5/2005 | Shozo et al. | 219/403 |

FOREIGN PATENT DOCUMENTS

| | | | |
|---|---|---|---|
| JP | 54-55684 | | 4/1979 |
| JP | 54-115448 | | 9/1979 |
| JP | 55-51208 | | 4/1980 |
| JP | 62-108702 | | 7/1987 |
| JP | 63176901 | A | 7/1988 |
| JP | 01136613 | A * | 5/1989 |
| JP | 6-24483 | | 4/1994 |
| JP | 8-178298 | | 7/1996 |
| JP | 10-281501 | | 10/1998 |
| JP | 2000-55423 | | 2/2000 |
| JP | 2000-201819 | | 7/2000 |
| JP | 2002-216875 | | 8/2002 |
| JP | 3761176 | B2 | 1/2006 |
| WO | WO 03/007764 | | 1/2003 |
| WO | 03/077605 | A1 | 9/2003 |

* cited by examiner

FIG. 8 (A1)
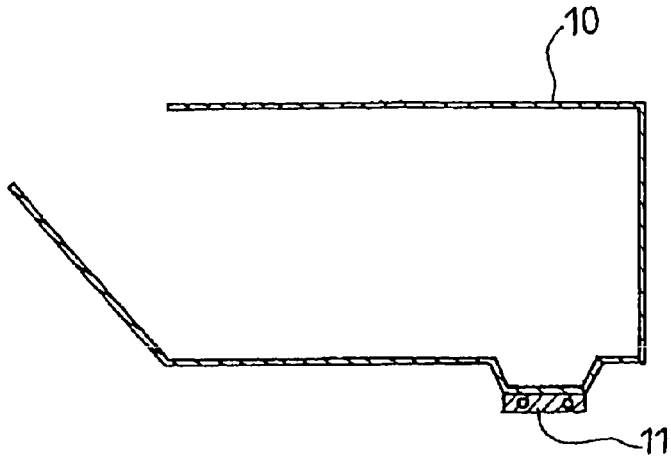
FIG. 8 (A2)
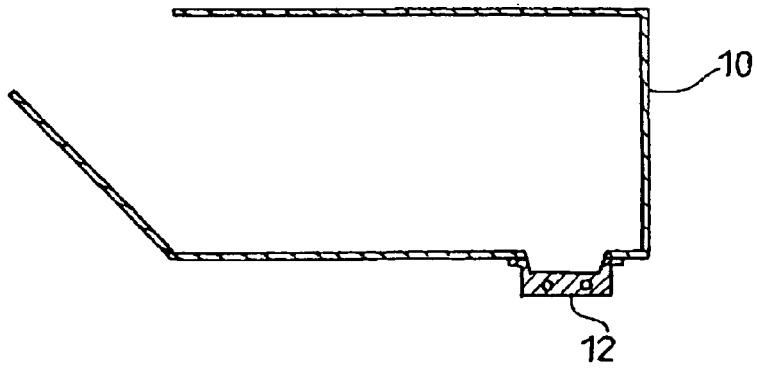
FIG. 8 (B)
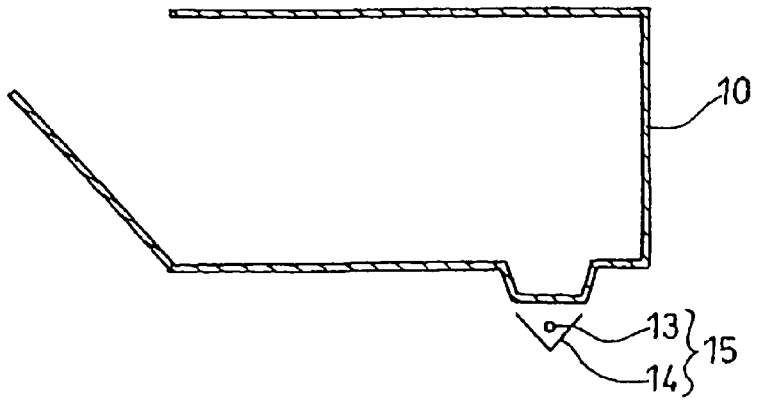

STEAM GENERATION FUNCTION-EQUIPPED HIGH-FREQUENCY HEATING DEVICE

TECHNICAL FIELD

The present invention relates to a high frequency heating apparatus having a steam generating function for carrying out a heating treatment on a heating target by combining high frequency heating and steam heating, and particularly to steam heating thereof

BACKGROUND ART

A high frequency heating apparatus having high frequency generating means for outputting high frequency waves to the inside of a heating chamber in which a heating target is accommodated has rapidly propagated as a microwave oven serving as cooking equipment for foodstuff, etc. because it can efficiently heat a heating target in a heating chamber in a short time. However, use of only heating based on high frequency heating has such a disadvantage that the cooking variations are limited.

Therefore, as conventional high frequency heating apparatuses have been provided a microwave oven having a high frequency wave generating apparatus for heating, a combination cooking range added with a convection heater for making a microwave oven generate hot air, etc. Furthermore, a steamer for introducing steam into the heating chamber to heat, a steam convection oven achieved by adding a steamer with a convection heater, etc. have been used as cooking devices.

When foodstuff is cooked by using a cooking device as described above, the cooling device is controlled so that the foodstuff has been cooked under the most excellent cooking state. That is, the cooking based on the combination of high frequency heating and hot air heating can be controlled by a combination cooking range, and the cooking based on the combination of steam heating and hot air heating can be controlled by a steam convection oven. However, the cooking based on the combination of high frequency heating and steam heating needs a labor of carrying out each of the heating treatments separately from each other while transferring heating target foodstuff between respective cooking devices. In order to overcome this disadvantage, a cooking device that can implement high frequency heating, steam heating and electric heating on its lone is known. This cooking device is disclosed in Patent Document 1, for example.

(Patent Document 1) JP-A-54-115448

According to this publication, a vaporizing chamber for generating heating steam is embedded at the lower side of the heating chamber, and water is supplied from a water tank with keeping a fixed water level at all times. Accordingly, it is difficult to carry out a daily cleaning work of the periphery of the heating chamber, and particularly in the vaporizing chamber, calcium, magnesium, etc. contained in water are condensed in the generating process of steam and precipitate and stick to the bottom portion of the vaporizing chamber and in pipes and thus the occurrence amount of steam is reduced, which causes such an unsanitary atmosphere that mold, etc. are liable to breed.

Furthermore, as a method of introducing steam into the heating chamber may be considered a system of generating steam by heating means such as a boiler or the like disposed at the outside of the heating chamber and supplying the steam thus generated into the heating chamber. However, there occur problems of breeding of miscellaneous bacteria in a pipe for introducing steam, breakage caused by freezing, contamination of foreign materials such as rust, etc., and it is frequently difficult to dismantle/clean the heating means. Therefore, the system of introducing steam from the outside is difficult to be adopted for cooking devices in which sanitation care is needed.

In many cases, a temperature sensor such as an infrared sensor or the like for measuring the temperature of a heating target is provided to a cooking device. In this case, when steam is fully filled in the heating chamber, the infrared sensor does not measure the temperature of the heating target, but measures the temperature of floated particles of steam existing between the heating target and the infrared sensor. Therefore, it is impossible to accurately measure the temperature of the heating target. In this case, heating control which is carried out on the basis of the temperature detection result of the infrared sensor is not normally operated, and thus a disadvantage such as insufficient heating, excessive heating or the like occurs. Particularly when automatic cooking is carried out according to a sequential procedure, the cooking process goes to a next step although heating fails, and the cooking target is irrecoverable by mere re-heating, standing to cool or the like, so that the cooking itself may finally fail.

Furthermore, heating cannot be necessarily performed according to a heating pattern having a high heating efficiency in accordance with the kind of the heating target and each temperature state of frozen articles, refrigerated articles or the like, and thus the heating time is lengthened.

Therefore, in consideration of the above situation, the applicant of this application has developed, as a prior invention, a high frequency heating apparatus having a steam generating function in which a steam generating portion can be easily cleaned and kept sanitary at all times, the temperature of a heating target can be accurately measured to carry out a proper heating treatment, and also the heating efficiency can be increased (see Patent Document 2).

(Patent Document 2) Japanese Patent Application No. 2002-216875 (Equivalent to WO 0307764)

FIGS. 1 to 7 show a high frequency heating apparatus having a steam generating function equipped with a steam generator according to the prior invention of the application of this application.

FIG. 1 is a front view showing the state that an opening/closing door of the high frequency heating apparatus is opened, FIG. 2 is a perspective view showing an evaporation tray of a steam generator used for this apparatus, FIG. 2 is a perspective view showing an evaporation tray heating heater and a reflection plate of the steam generator, and FIG. 4 is a cross-sectional view showing the steam generator.

The high frequency heating apparatus 60 having the steam generating function is a cooling device for supplying at least one of high frequency waves (microwave) and steam to a heating chamber 62 in which a heating target is accommodated, thereby cooking the heating target, and it comprises a magnetron 70 serving as the high frequency generator for generating high frequency waves, a steam generator 69 for generating steam in the heating chamber 62, a circulating fan 64 for stirring and circulating air in the heating chamber 62, a convection heater 66 serving as an indoor air heating heater for heating air circulated in the heating chamber 62, and an infrared sensor 63 for detecting the temperature in the heating chamber 62 through a detection hole formed in the wall surface of the heating chamber 62.

The heating chamber 62 is formed in the box-shaped main body case 61 which is opened at the front side thereof, and an opening/closing door 71 having a light transmissible window 71*a* for opening/closing the heating target take-out port of the heating chamber 62 is provided to the front side of the main body case 61. The opening/closing door 71 is joined to the lower edge of the main body case 61 at the lower end thereof through a hinge so that the opening/closing door 71 can be opened/closed in the vertical direction. A predetermined adiabatic space is secured between the wall surfaces of the heating chamber 62 and the main body case 61, and the space is filled with adiabatic material as occasion demands. Particularly, a space at the back side of the heating chamber 62 serves as a circulating fan room 67 in which the circulating fan 64 and a driving motor 84 (see FIG. 7) are accommodated, and the wall of the back surface of the heating chamber 62 serves as a partition plate 68 through which the heating chamber 62 and the circulating fan room 67 are compartmented. Air suction vent holes for sucking air from the heating chamber 62 side to the circulating fan room 67 side and air blowing vent holes 72 for blowing air from the circulating fan room 67 side to the heating chamber 62 side are formed in the partition plate 68 so that the formation areas thereof are discriminated from each other. The respective vent holes 65, 72 are formed as many punch holes.

The circulating fan 64 is disposed so that the rotational center thereof is located at the center portion of the rectangular partition plate 68, and a rectangular and annular convection heater 66 is provided in the circulating fan room 67 so as to surround the circulating fan 64. The air suction vent holes 65 formed in the partition plate 68 are disposed in front of the circulating fan 64, and the air blowing vent holes are disposed along the rectangular and annular convection heater 66. The circulating fan 64 is set so that air flows from the front side of the circulating fan 64 to the rear side thereof at which the driving motor 84 is located when the circulating fan 64 is rotated. Therefore, air in the heating chamber 62 is sucked through the air suction vent holes 65 to the center portion of the circulating fan 64, passed through the convection heater 66 in the circulating room 67 and then blown out from the air blowing vent holes 72 to the heating chamber 62. Accordingly, through this air flow, the air in the heating chamber 62 is circulated through the circulating fan 67 while stirred.

The magnetron 70 is disposed in a space below the heating chamber 62, for example, and a stirrer vane 73 is provided at a position where high frequency waves generated by the magnetron are received. The high frequency waves from the magnetron 70 are irradiated to the rotating stirrer vane 73, and the high frequency waves are supplied to the heating chamber 62 by the stirrer vane 73 while stirred. The location of the magnetron 70 and the stirrer vane 73 is not limited to the bottom portion of the heating chamber 62, but they may be located at the upper surface of the heating chamber 62 or at the side surface thereof.

As shown in FIG. 2, the steam generator 69 comprises an evaporation tray 75 having a water stocking recess place 75*a* for generating steam by heating, an evaporation tray heating heater 76 that is disposed at the lower side of the evaporation tray 75 and heats the evaporation tray 75, and a reflection plate 77 having a substantially U-shaped section for reflecting radiation heat of the heater to the evaporation tray 75. The evaporation tray 75 is formed of stainless and designed to have an slender plate shape, and it is disposed at the bottom surface of the back side opposite to the heating target take-out port of the heating chamber 62 and oriented so that the longitudinal direction thereof is along the partition plate 68. A glass tube heater, a sheathed heater, a plate heater or the like is usable as the evaporation tray heating heater 76.

FIG. 5 is a block diagram showing a control system for controlling the high frequency heating apparatus 60 having the steam generating function. This control system is mainly constructed by a controller 701 having a microprocessor, for example. The controller 701 mainly receives/transmits signals from/to a power supply portion 703, a storage portion 705, an input operating portion 707, a display panel 709, a heating portion 711, a cooling fan 81, etc.

The input operating portion 707 is connected to various operating switches such as a start switch 719 for instructing start of heating, a switching switch 721 for switching a heating method such as high frequency heating, steam heating, etc., an automatic cooking switch 723 for starting programs stored in advance, etc.

The heating portion 711 is connected to the high frequency generator 70, the steam generator 69, the circulating fan 64, the infrared sensor 63, etc. The high frequency generator 70 is operated in cooperation with a radio stirring portion (the driving portion of the stirrer vane) 73, and the steam generator 69 is connected to the evaporation tray heating heater 76, the indoor air heating heater 66 (convection heater), etc. Elements other than the mechanical constituent elements described above (for example, a water feeding pump 80, a door air blowing dumper 82, an exhaust dumper 83, etc.) are contained in this block diagram, however, this will be described by embodiments described later.

Next, the basic operation of the high frequency heating apparatus 60 having the steam generating function described above will be described with reference to the flowchart of FIG. 6.

As an operating procedure, foodstuff to be heated is put on a dish or the like and inserted into the heating chamber 62 and then the opening/closing door 71 is closed. The heating method, the heating temperature or time are set by the input operating portion 707 (step 10, subsequently will be abbreviated as S10), and the start switch is turned on (S11). At this time, the heating treatment is automatically carried out by the operation of the controller 701 (S12).

That is, the controller 701 reads out the heating temperature/time thus set, selects/executes the optimal cooking method on the basis of the heating temperature/time thus read out, and judges whether the heating temperature/time thus set is reached (S13). When it reaches the set value, each heating source is stopped and the heating treatment is finished (S14). In S12, generation of steam, the indoor air heating heater, the rotation of the circulating fan and the high frequency heating are individually or simultaneously carried out.

The operation carried out when a mode of "generating stream +turning on circulating fan", for example, is selected/executed in the above-described operation will be described. When this mode is selected, the evaporation tray heating heater 76 is turned on to heat water of the evaporation tray 76, and thus steam S occurs as indicated in the diagram showing the operation of the high frequency heating apparatus 60 in FIG. 7. The steam S rising from the evaporation tray 75 is sucked from the air suction vent holes 65 provided substantially at the center portion of the partition plate 68 to the center portion of the circulating fan 64. Then, the steam S is passed through the circulating fan room 67, and blown out from the air blowing vent holes 72 provided to the peripheral portion of the partition plate 68 into the heating chamber 67. The steam thus blown out is stirred in the heating chamber 62, and sucked from the air suction vent holes 65 substantially at the center portion of the partition plate 68 to the circulating fan room 67 side again. Accordingly, a circulation path is formed between the inside of the heating chamber 62 and the circulating fan room 67. No air blowing vent hole 72 is provided below the location position of the circulating fan 64 of the partition plate 68, so that generated steam is introduced to the air suction vent holes 65. As indicated by outlined arrows in the figures, steam is circulated in the heating chamber 62, whereby the steam is sprayed to the heating target M.

At this time, by turning on the indoor air heating heater 66, the steam in the heating chamber 62 is heated, and thus the temperature of the steam circulated in the heating chamber 62 can be set to a high temperature. Accordingly, so-called overheated steam is achieved, and cooking can be carried out so that the surface of the heating target M gets burned. Furthermore, when high frequency heating is carried out, the magnetron 70 is turned on and the stirrer vane 73 is rotated, whereby high frequency waves are supplied into the heating chamber 62 while stirred and high frequency cooking can be uniformly performed.

As described above, according to the high frequency heating apparatus of the prior invention, steam is generated not at the outside of the heating chamber 62, but in the heating chamber 62. Therefore, the evaporation tray 75 on which steam occurs can be easily cleaned as in the case where the inside of the heating chamber 62 is cleaned. For example, in the process of occurrence of steam, calcium, magnesium, chlorine compound, etc. are condensed, and they precipitate and stick at the bottom portion of the evaporation tray 75. However, the materials adhering to the surface of the evaporation tray 75 can be cleanly removed by wiping out them with cloth or the like.

Furthermore, as described with reference to FIG. 4, the evaporation tray disposed in the high frequency heating apparatus is heated by radiation heat of the heater, and the radiation heat from the heater is reflected from the reflection plate to the evaporation tray, so that the heating efficiency is increased.

As described above, in the prior invention, the heating efficiency is more greatly enhanced than the conventional apparatus, and the maintenance thereof can be easily performed.

However, the applicant of this application has not yet been satisfied with the above invention, and has sought further increase of the heating efficiency. However, the reflection plate is bulky and it obstructs the trend of miniaturization, and the applicant considers that this is not used.

The present invention has an object to overcome these disadvantages, and provide a high frequency heating apparatus having a miniaturized steam generator in which when water is dropped, the dropped water can be remarkably speedily evaporated with even the same watt value.

Furthermore, the present invention has an object to provide a high frequency heating apparatus having a steam generating function in which a steam generator can be easily cleaned and keeps sanitary at all times, an optimal amount of steam is generated for foodstuff, miniaturization is implemented and the heating efficiency is increased.

DISCLOSURE OF THE INVENTION

In order to solve the above problem, according to the present invention, a high frequency heating apparatus having a steam generating function equipped with a high frequency wave generator and a steam generator that comprises an evaporation tray provided at the bottom surface of a heating chamber having a heating target mounted therein and a heater device for heating the evaporation tray and generates steam in the heating chamber is characterized in that the heater device is constructed by embedding a sheathed heater in an aluminum die cast, and the heater device is directly attached to the back side of the evaporation tray.

With the construction as described above, the speed from dropping of water until the dropped water is evaporated is more remarkably increased even when the same watt value as the conventional device and the prior invention is applied.

Furthermore, according to the present invention, a high frequency heating apparatus having a steam generating function equipped with a high frequency generator, and a steam generator that comprises an evaporation tray supporting opening portion provided at the bottom surface of a heating chamber having a heating target mounted therein, and a heater device closing the evaporation tray supporting opening portion and generates steam in the heating chamber, is characterized in that the heater device is constructed by setting the upper surface of an aluminum die cast as an evaporation tray and embedding a sheathed heater in the lower surface thereof, and the heater device is secured to the evaporation tray supporting opening portion so that the evaporation tray of the heater device faces the evaporation tray supporting opening portion.

With the above construction, the water heating speed is further increased.

Still furthermore, the high frequency heating apparatus having the steam generating function is characterized in that a metal seal is provided between the evaporation tray supporting opening portion and the heater device.

With the above construction, electric wave leakage of microwaves which may leak from the gap between the evaporation tray supporting opening portion and the heater device can be perfectly prevented.

Furthermore, the high frequency heating apparatus having the steam generating function is characterized in that a thermistor is provided to the aluminum die cast, and the control of the amount of evaporation from the evaporation tray and the control under abnormality when water on the evaporation tray is wasted are performed on the basis of temperature information from the thermistor.

With this construction, the control of the evaporation amount and the overheat control under abnormality can be performed with a simple construction.

Furthermore, the high frequency heating apparatus having the steam generating function ceases power supply to the heating apparatus and stops steam heating when the thermistor is set to off-level sequentially twice or at a predetermined higher number of times.

With this construction, the overheat control under abnormality can be rapidly performed.

Furthermore, in the high frequency heating apparatus having the steam generating function, the heating apparatus is constructed by embedding the sheathed heater in the aluminum die cast in U-shape, and the thermistor is secured in a hole formed between the two long axes of the U-shape concerned.

With the above construction, the thermistor can accurately detect the temperature around the evaporation tray.

Furthermore, the high frequency heating apparatus having the steam generating function of the present invention is characterized in that the steam generator is provided to one or both sides of the back side opposite to the heating target take-out port of the heating chamber.

With the above construction, the steam generator does not function as an obstacle to cooking, and burn risk can be avoided. Furthermore, by disposing a plurality of steam generators, the steam amount can be more easily controlled.

Furthermore, the high frequency heating apparatus having the steam generating function is characterized in that a water supply pipe is fixed to the aluminum die cast.

With the above construction, water in the water supply pipe is heated, and thus the evaporation time can be shortened by supplying the water concerned to the evaporation tray. Therefore, pumpless water supply to the evaporation tray by a siphon can be performed by using thermal expansion of the water in the water supply pipe.

Still furthermore, a high frequency heating apparatus having a steam generating function according to the present invention is characterized in that a water supply pipe is used as a part of a water supply pipe line for supplying a predetermined amount of water from a water tank to a predetermined amount of water, atmospheric pressure take-in port is provided at some midpoint of the water supply pipe line directing to from the water supply pipe to the evaporation tray, water is expanded by rapidly heating the water in the water supply pipe, and the expanded water is passed through the air take-in port to start a siphon function.

With this construction, no water feeding pump is needed, and reduction of the number of parts, space saving and energy saving can be performed.

In order to solve the above object, a high frequency heating apparatus having a steam generating function according to the present invention that includes high frequency wave generating means for outputting high frequency waves into a heating chamber in which a heating target is accommodated, and a steam supply mechanism for supplying heating steam into the heating chamber, at least one of the high frequency waves and the heating steam being supplied to the heating chamber to carry out a heating treatment on the heating target, is characterized in that the steam supply mechanism comprises a water tank detachably secured to the main body of the apparatus, a water supply tray mounted in the heating chamber, and heating means for heating the water supply tray to evaporate water on the water supply tray, wherein the heating means has a sheathed heater formed so as to be bent in a substantially U-shape and water is dropped onto the surface of the water supply tray above the bent site of the sheathed heater.

In the high frequency heating apparatus having the steam generating function thus constructed, even a steam supply mechanism having a relatively large output can be miniaturized by forming the sheathed heater while bending the sheathed heater in the substantially U-shape, and it can prevent occurrence of such heating unevenness that there occur both of an area supplied with water and an area supplied with no water. Furthermore, water supplied to the water supply tray is dropped to the water supply tray above the bent site of the substantially-U-shaped sheathed heater at which the sheathed heater is relatively liable to increase in temperature. Therefore, a time needed from the supply of water to the water supply tray until occurrence of steam can be shortened, and rapid steam heating can be performed.

Furthermore, a high frequency heating apparatus having a steam generating function according to the present invention that includes high frequency wave generating means for outputting high frequency waves into a heating chamber in which a heating target is accommodated, and a steam supply mechanism for supplying heating steam into the heating chamber, at least one of the high frequency waves and the heating steam being supplied to the heating chamber to carry out a heating treatment on the heating target, is characterized in that the steam supply mechanism comprises a water tank detachably secured to the main body of the apparatus, a water supply tray mounted in the heating chamber, heating means for heating the water supply tray to evaporate water on the water supply tray, a water supply path for introducing water in the water tank through a heating area based on the heating means to the water supply tray, and a water supply nozzle for supplying water on the water supply tray, wherein the heating means is formed by disposing a sheathed heater bent in a substantially U-shape in an assembly block of aluminum die cast, and the nozzle tip of the water supply nozzle is disposed in the neighborhood of the bent site of the sheathed heater.

In the high frequency heating apparatus having the steam generating function thus constructed, water supplied to the water supply tray is kept to be increased in temperature by the generated heat of the heating means. Therefore, the time required from the supply of water to the water supply tray till occurrence of steam can be shortened, and the steam heating can be rapidly performed. Furthermore, the water supply nozzle for supplying water on the water supply tray is disposed in the neighborhood of the bent side of the sheathed heater, so that water can be surely supplied to the high temperature portion of the heating means and the time required till occurrence of steam can be further shortened.

Furthermore, the high frequency heating apparatus having the steam generating function according to the present invention is characterized in that the steam supply mechanism is equipped with a temperature detecting sensor for detecting the temperature of the heating means or the water supply tray, and the temperature detecting sensor is disposed at the center portion of the sheathed heater which is formed so as to be bent in the substantially U-shape.

When the residual amount of the water tank is equal to 0 (zero) and the residual amount on the water supply tray is reduced, the quantity of heat to be consumed for evaporation of water, so that the temperature of the heating means and the water supply tray is increased. Particularly, the center portion of the sheathed heater which is formed so as to be bent substantially in U-shape is a place at which the temperature is increased to the highest level, and thus it is easily to grasp the variation of the increase of the temperature.

Accordingly, as described above, the temperature sensor for detecting the temperature of the heating means or the water supply tray is provided, and the detection signal of the temperature sensor is monitored, so that the detection of the residual amount 0 of the water tank can be performed.

Furthermore, by utilizing the detection signal of the temperature sensor, various kinds of control such as stop of the operation of the heating means, emitting an alarm for water supply, etc. can be performed when the residual amount 0 of the water tank is detected, and thus the handling performance of the high frequency heating apparatus can be enhanced.

Furthermore, the high frequency heating apparatus having the steam generating function is characterized in that the steam supply mechanism is designed so that a slit is provided at the outer peripheral portion of the temperature detecting sensor disposed at the center portion of the sheathed heater which is formed so as to be bent substantially in U-shape.

The temperature detecting sensor disposed at the assembly block can detect not only the temperature of the heater equipped to the assembly block, but also as the temperature lowered by the temperature of water on the water supply tray coming into contact with the assembly block. Furthermore, the slit is provided at the outer peripheral portion of the temperature detecting sensor disposed at the center portion of the sheathed heater. Therefore, the block temperature in the vicinity of the temperature detecting sensor is hardly affected by the temperature of the sheathed heater adjacent to the block, and the presence or absence of water on the water supply tray can be more accurately detected.

The high frequency heating apparatus having the steam generating function of the present invention is characterized in that in the steam supply mechanism, material having high thermal conductivity and flexibility is sandwiched between the heating means and the water supply tray and fixed under a close contact state.

In the steam supply mechanism, the aluminum die case block serving as the heating means is fixed to the water supply tray in close contact with each other, and the heat is transferred to the water supply tray to generate steam. Minutely uneven portions exist on the surface of the aluminum die cast and the surface of the water supply tray are minutely uneven because they are metal, and loss occurs in the conductive heat when an air layer is formed therebetween. However, if material having high thermal conductivity and flexibility is sandwiched between them, the air layer based on the minutely uneven portions can be eliminated, and thus there can be provided a steam supply mechanism which has small loss and accurately detect the temperature.

Furthermore, the high frequency heating apparatus having the steam generating function according to the present invention is characterized in that in the steam supply mechanism, a temperature detecting sensor is inserted and fixed together with material having high thermal conductivity in a hole formed in the heating means of the assembly block of aluminum die cast.

The temperature detection sensor disposed in the assembly block is inserted and fixed in the hole provided to the assembly block, and mainly detects the temperature of heater block itself However, if a space exists between the sensor and the block, the response is lowered by the adiabatic effect of the space. However, by inserting the temperature detecting sensor together with the material having high thermal conductivity and flexibility, the space is eliminated and the steam supply mechanism having high response to the temperature detector can be provided.

In order to solve the above problem, the high frequency heating apparatus having the steam generating function according to the present invention is characterized in that a holding plate for holding the heater device is provided, and the holding plate is disposed to be pressed against the back side of the evaporation tray of the heater device.

With this construction, the heater device is kept in close contact wit the evaporation tray at all times, and the heat of the heater device is transmitted to water and thus current supply is prevented from being set to OFF by the thermistor. Therefore, a stable steam amount can be provided.

Furthermore, the high frequency heating apparatus having the steam generating function according to the present invention is designed so that particularly the holding plate is not fastened to the evaporation tray by a screw. Therefore, the evaporation tray and the heater device are interlocked with each other at all times, and even when the evaporation tray is deformed by the heat of the heater device and a gap occurs, the holding plate presses the heater device so that the heater device can be kept in close contact with the evaporation tray.

Furthermore, the high frequency heating apparatus having the steam generating function according to the present invention is designed so that particularly the evaporation tray is designed to have a convex shape in the longitudinal direction of the heater device, whereby the close contact between the heater device and the evaporation tray can be further enhanced.

Furthermore, the high frequency heating apparatus having the steam generating function according to the present invention is designed so that particularly the holding plate is designed to have a convex shape in the longitudinal direction of the heater device, whereby the close contact between the heater device and the evaporation tray can be further enhanced.

BRIEF DESCRIPTION OF THE DRAWINGS

FIG. 8 is a side cross-sectional view showing the construction of a heating apparatus according to the present invention, wherein A1 shows a first embodiment of the present invention, A2 shows a second embodiment and B shows the prior art described above;

Figure 1:
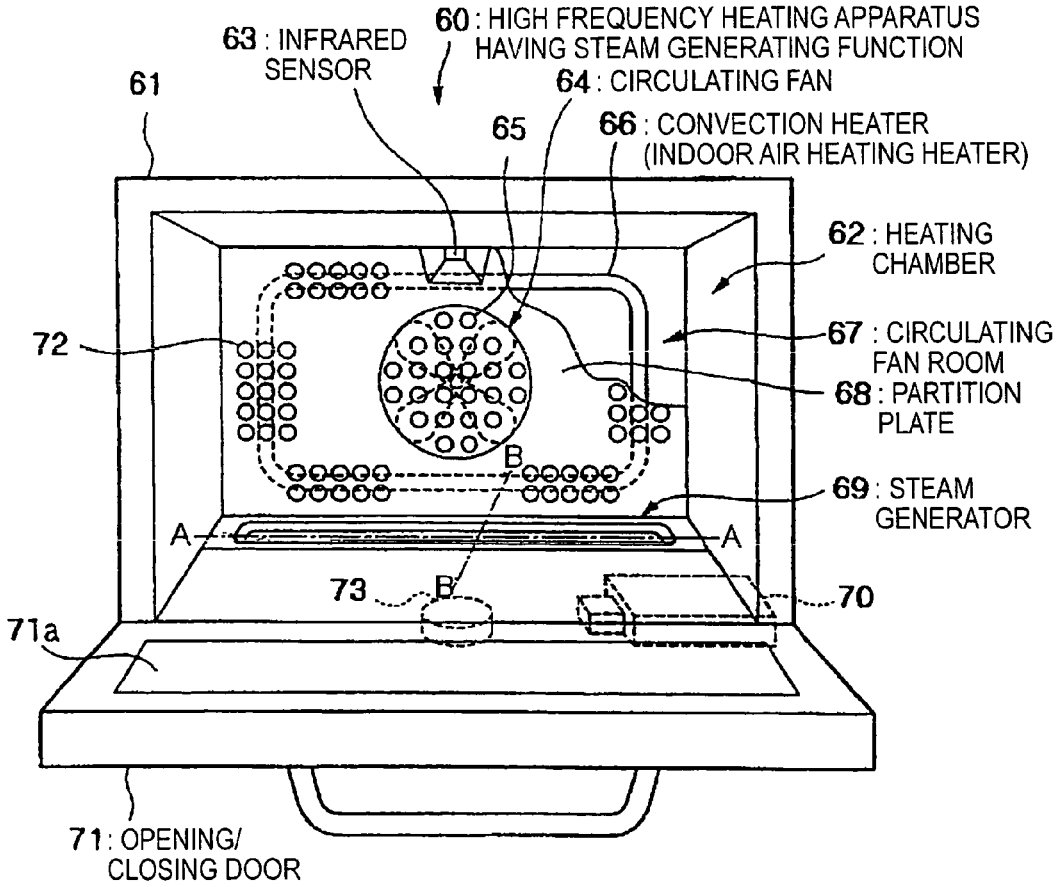
FIG. 1 is a front view showing the state that a door of a high frequency heating apparatus having a steam generating function according to a first embodiment of the present invention is opened.
Figure 2:
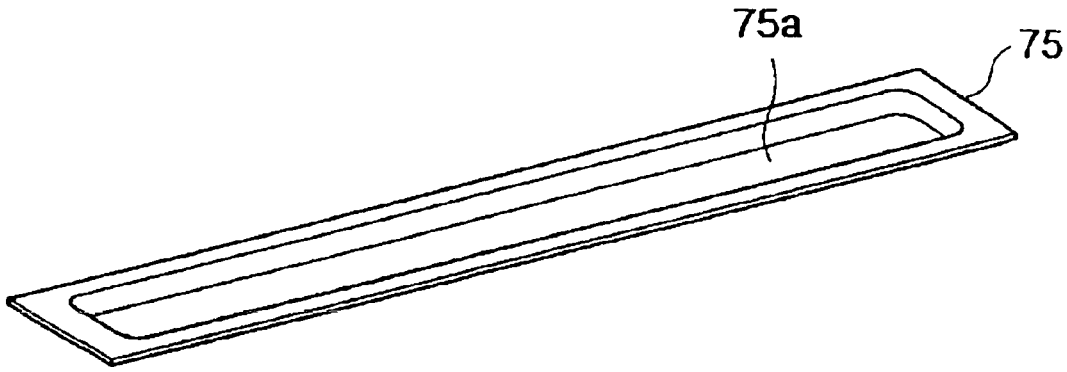
FIG. 2 is a perspective view showing an evaporation tray of a steam generator used in the high frequency heating apparatus having the steam generating function shown in FIG. 1.
Figure 3:
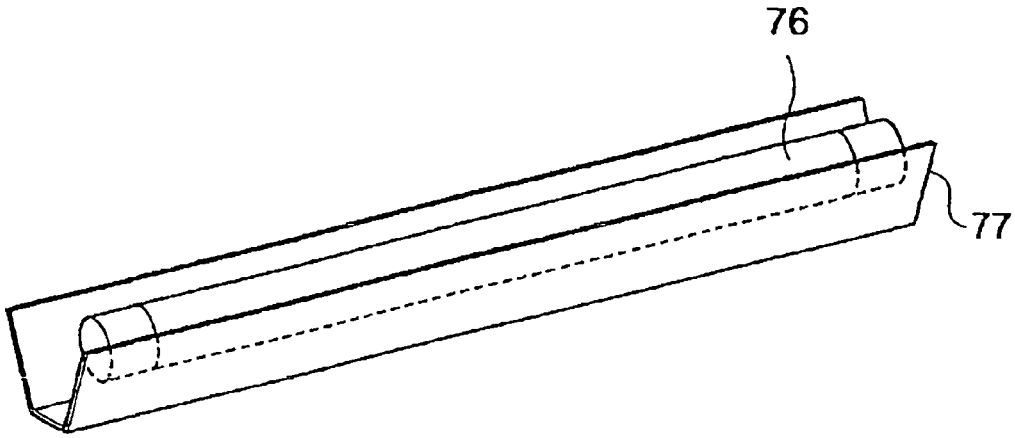
FIG. 3 is a perspective view showing an evaporation tray heater and a reflection plate of the steam generator.
Figure 4:
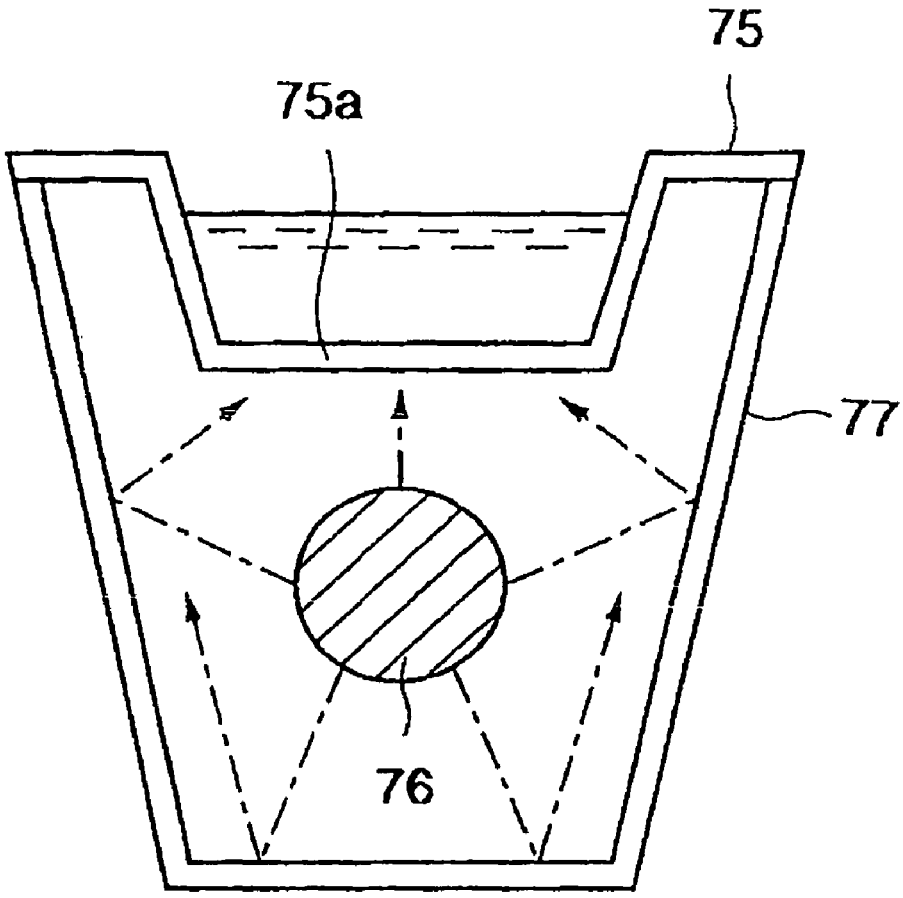
FIG. 4 is a cross-sectional view showing the steam generator of the apparatus.
Figure 5:
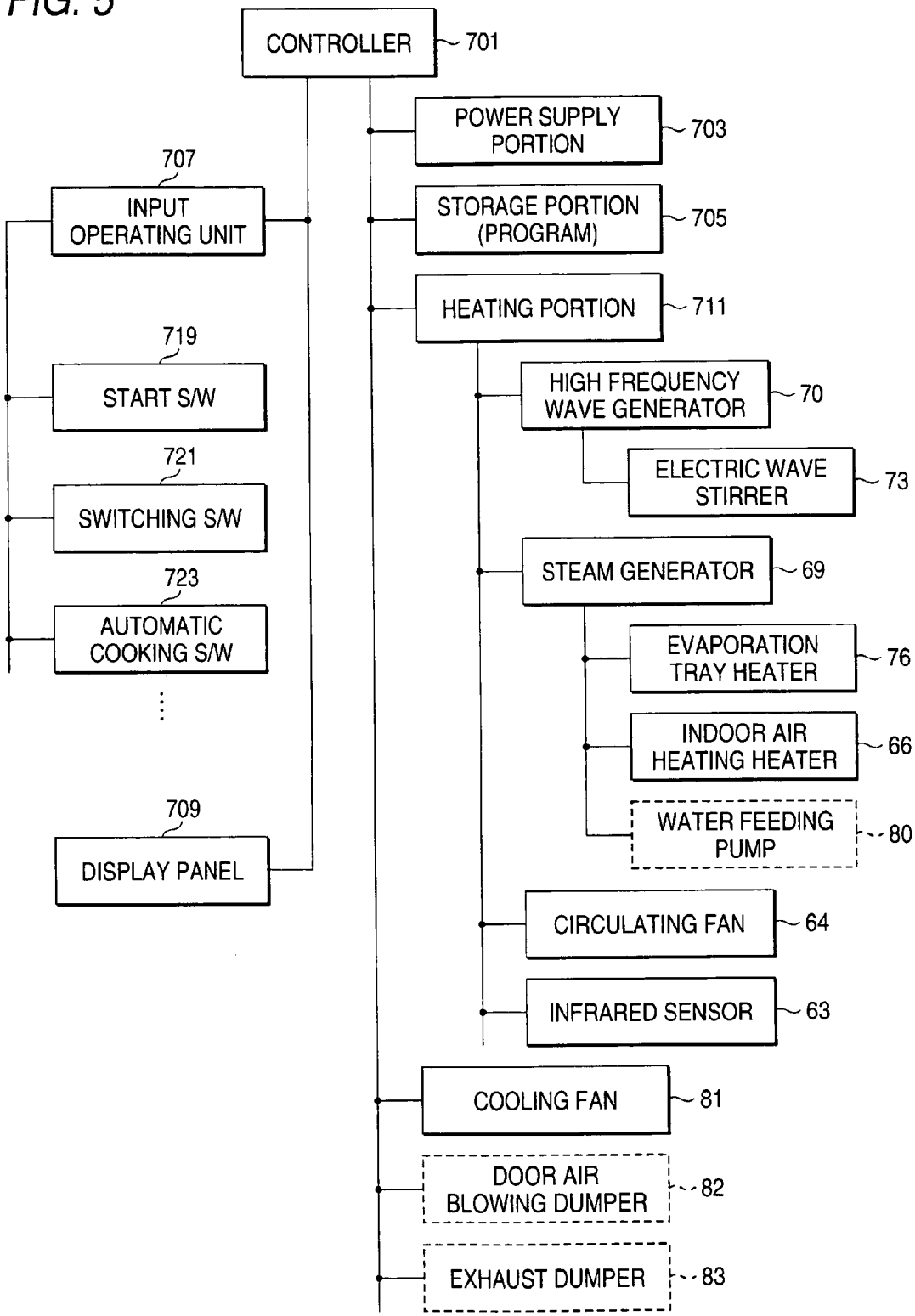
FIG. 5 is a block diagram showing a control system for controlling the high frequency heating apparatus having the steam generating function.
Figure 6:
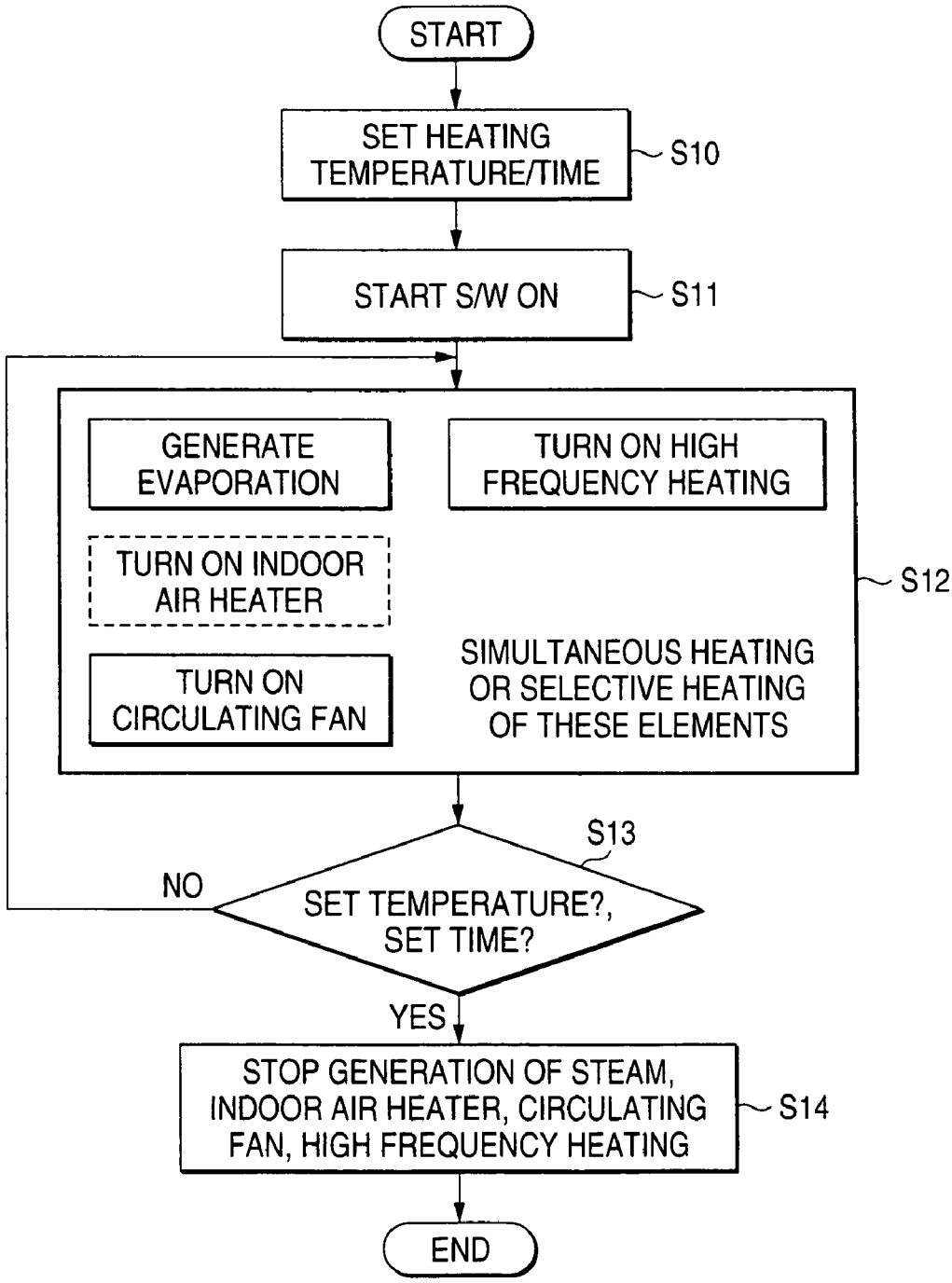
FIG. 6 is a flowchart showing the basic operation of the high frequency heating apparatus having the steam generating function.
Figure 7:
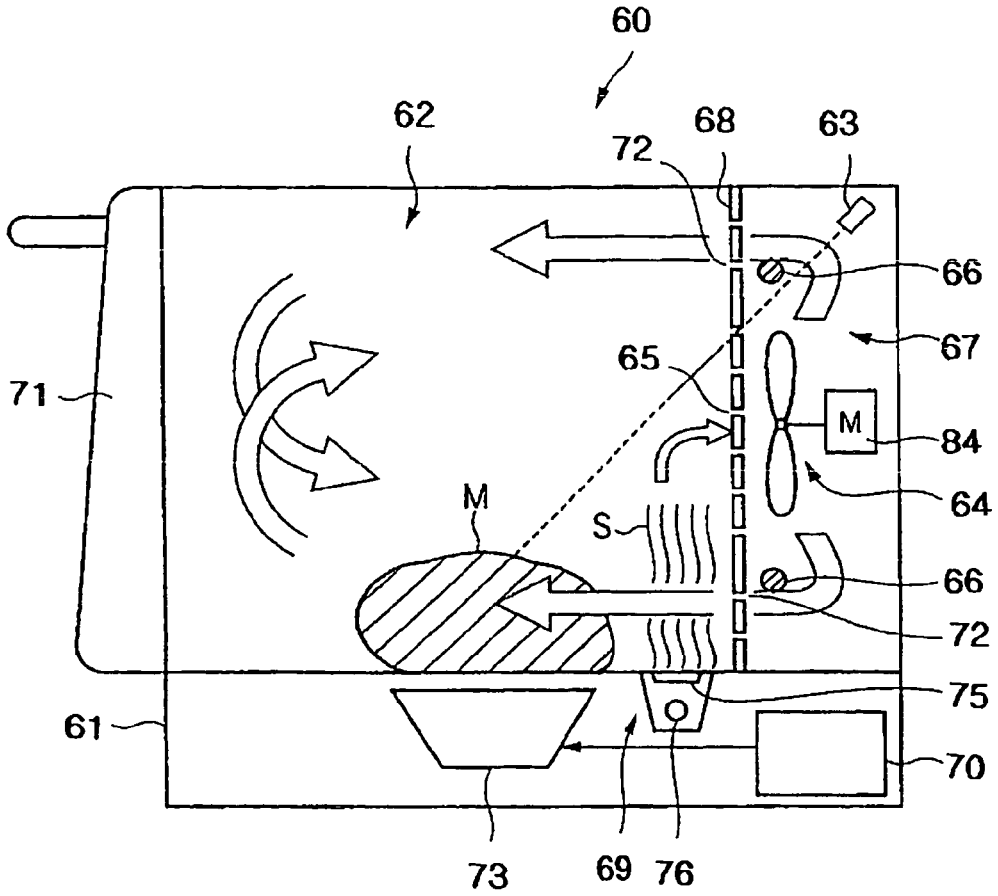
FIG. 7 is a diagram showing the operation of the high frequency heating apparatus having the steam generating function.

Reference numerals in the figures, 10 represents the housing of the main body of an apparatus, 11 represents a planar heater device, 11*a*, 11*b* represents a boss portion, 111 represents a contact portion of an aluminum die cast, 111*a* represents a thermistor mount hole 112 represents a securing portion, 113 represents an U-shaped type sheathed heater, 114 represents a water supply pipe, 117 represents a screw hole, 12 represents a deep tray container type heater device, 12*a*, 12*b* represents a boss portion, 121 represents an evaporation tray portion, 123 represents a U-shaped type sheathed heater, 124 represents a water supply pipe, 126 represents a metal seal, 19 represents a screw, 20 represents a metal evaporation tray, 21 represents the side surface of the tray, 22 represents the bottom portion, 23 represents a screw hole, 30 represents an evaporation tray support plate, 31 represents a hollow-out portion, 32 represents a metal plate, 33 represents a screw hole, 45 represents an evaporation tray, 50 represents a thermistor, 90 represents the main body of the apparatus, 91 represents a steam supply mechanism, 92 represents a water tank, 93 represents a heating chamber, 94 represents a heater device, 95 represents a water supply path, 95*a* represents a base end pipe portion, 95*b* represents a horizontal pipe portion, 95*c* represents a vertical pipe portion, 95*d* represents an air take-in port, 95*e* represents an upper pipe portion, 95*f* represents a water blow-out port, 96 represents a waterproof valve, 96*a* represents a tank-side waterproof valve, 96*b* represents a water supply path side waterproof valve, 97 represents a check valve, 95*a* represents a base end pipe portion, 95*e* represents an upper pipe portion, 95*f* represents a water blow-out port, 98 represents a bottom plate, 153 represents a heating chamber, 154 represents a bottom plate, 155 represents high frequency generating means, 157 represents a steam supply mechanism, 163 represents an opening/closing door, 165 represents a partition wall, 167 represents a stirrer vane, 171 represents a water tank, 172 represents a connection port, 173 represents a tray heat-transmitting material, 175 represents a water supply tray, 176 represents a slit portion, 177 represents heating means, 177*a* represents an assembly block, 178 represents a sheathed heater, 178*a* represents an U-bent portion, 179 represents a water supply path, 179*a* represents a base end pipe portion, 179*b* represents a horizontal pipe portion, 179*c* represents a vertical pipe portion, 179*d* represents an upper pipe portion, 179*e* represents a water supply nozzle, 185 represents a tank accommodating portion, 191 represents a thermistor (temperature detecting sensor), 192 represents a thermistor heat transmitting material, 193 represents a thermistor-fixed block, 195 represents a pipe-side waterproof valve, 197 represents a check valve, 206 represents an evaporation tray, 207 represents a heating chamber, 208 represents a heater device, 209 represents a holding plate and 210 represents a screw.

BEST MODES FOR CARRYING OUT THE INVENTION

Preferable embodiments of a high frequency heating apparatus having a steam generating function according to the present invention will be described hereunder with reference to the accompanying drawings.

FIG. 8 is a side cross-sectional view showing the construction of a heating apparatus according to the present invention, A1 shows a first embodiment of the present invention, A2 shows a second embodiment and B shows the prior invention described above.

First Embodiment

In (A1) of FIG. 8 showing the first embodiment, 10 represents the housing of the main body of the apparatus, 11 represents a planar heater device. The planar heater device 11 is achieved by shaping into a plate-like form a heater device in which a U-shaped type sheathed heater is embedded in aluminum die cast, and it is characterized in that the plate-shaped portion is directly fixed to the back side of an iron evaporation tray.

Figure 9:
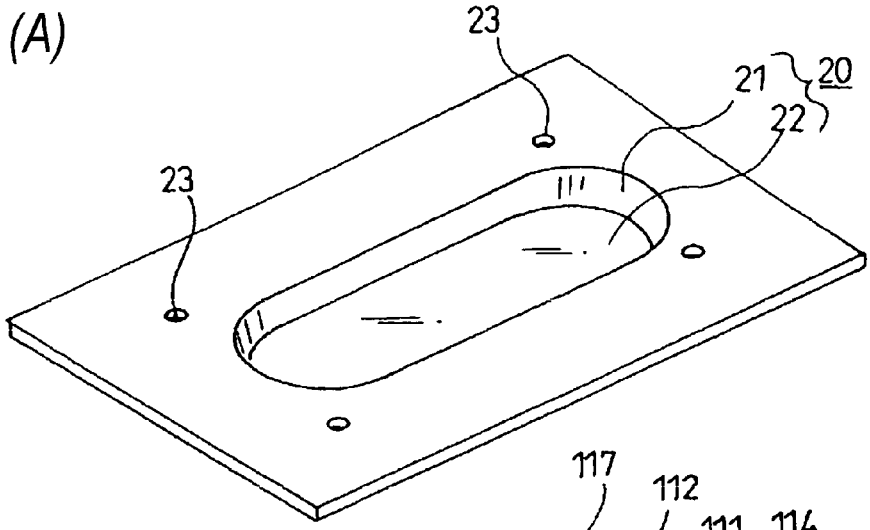
FIG. 9 is an exploded perspective view showing a planar heater device according to the first embodiment, wherein (A) shows an evaporation tray, (B) is a perspective view showing the heater device, and (B1) and (B2) are perspective views at the fixing side to the evaporation tray and the back side, respectively.
Figure 9:
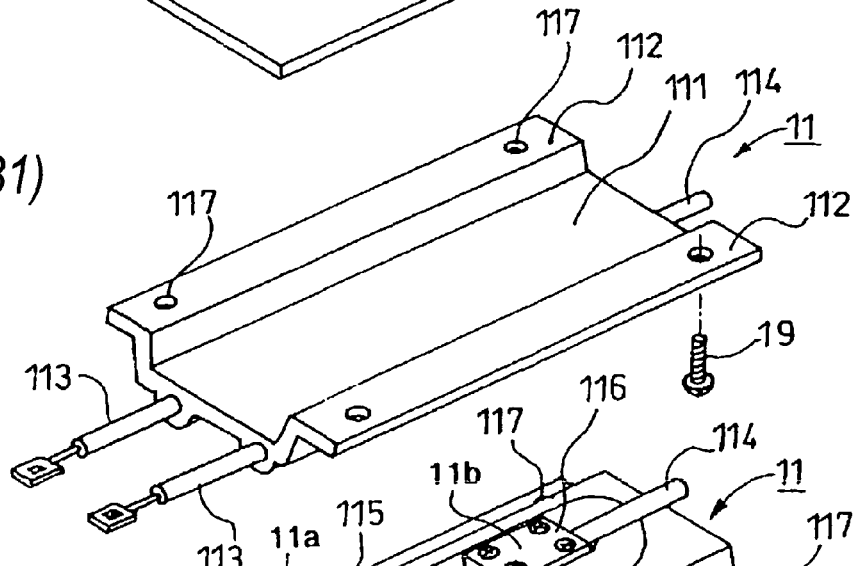
Figure 9:
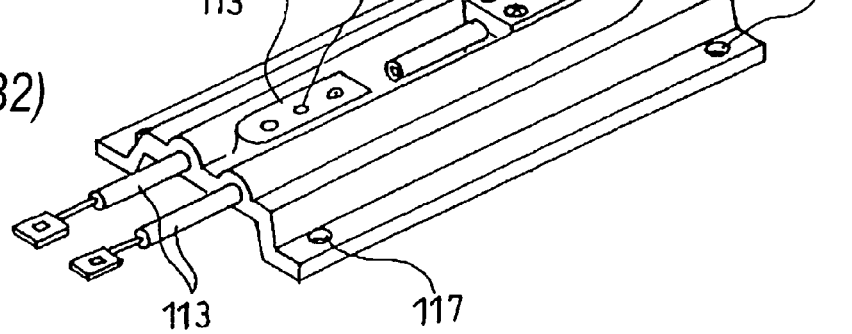

FIG. 9 is an exploded perspective view showing the planar heater device, (A) is a perspective view showing an evaporation tray, (B) is a perspective view showing a heater device, (B1) is a perspective view of the fixing side to the evaporation tray, and (B2) is a perspective view showing the back side.

In (A), 20 represents a metal evaporation tray. A tray portion is constructed by the side surface 21 of the tray and the bottom portion 22, and screw holes 23 are formed.

In (B1), 11 represents a heater device formed of an aluminum die cast, 111 represents a contact portion to the evaporation tray bottom portion 11, 112 represents a fixing portion, and 113 represents a casted U-shaped sheathed heater. A screw hole 117 and a screw hole 23 of (A) are fixed by screws.

In (B2), the same reference numerals as (B1) represent the same elements and thus the description thereof is omitted. In this case, it is understood that the sheathed heater 113 is casted in U-shape. Two boss portions 11*a*, 11*b* are formed on the back side of the aluminum die cast, and an insertion hole in which a thermistor described later is inserted is formed at the first boss portion 11*a* at the left side of the figure.

Furthermore, a water supply pipe 114 described later is fixed to the second boss portion 11*b* at the right side of the figure.

With this construction, heat generated in the sheathed heater 113 is directly thermally transmitted from the aluminum die cast contact portion 111 to the evaporation tray 20. Therefore, the heat conduction speed is more remarkably high as compared with a conventional radiation type heating apparatus 15 based on a pipe heater 13 and a reflection plate 14, and thus the cooking speed based on steam is increased.

Furthermore, the apparatus can be miniaturized.

Table 1 is a comparison table between a steam generating mechanism of the present invention and a conventional example as a prior invention when a heater having the same watt value is used.

TABLE 1

| | PRESENT INVENTION | CONVENTIONAL EXAMPLE |
|---|---|---|
| EVAPORATION START TIME | 30 SECONDS | 60 SECONDS |
| STEAM AMOUNT | 12-13 cc/min. | 10 cc/min. |

When a time from current supply to the heater device till start of evaporation was measured, the conventional example needed about 60 seconds, however, the present invention needed about 30 seconds, so that the present invention could shorten the time by about 30 seconds.

Paying attention to the amount of steam occurring, the conventional example provided 10 cc per minute, however, the present invention provided 12 to 13 cc per minute, so that the present invention could evaporate a larger amount of water by 20 to 30%. As described above, the cooking time can be shortened by shortening the start time and increasing the steam amount.

Second Embodiment

In (A2) of FIG. 8 showing the second embodiment, 10 represents the housing of the main body of the apparatus, and 12 represents a deep tray container type heater device. The deep tray container type heater device 12 is characterized in that a heater device in which a sheathed heater is embedded in an aluminum die cast is shaped like a deep tray container, an evaporation tray formed of iron is partially hollowed out and the deep tray container type heater device is fitted in the hollow-out portion.

Figure 10:
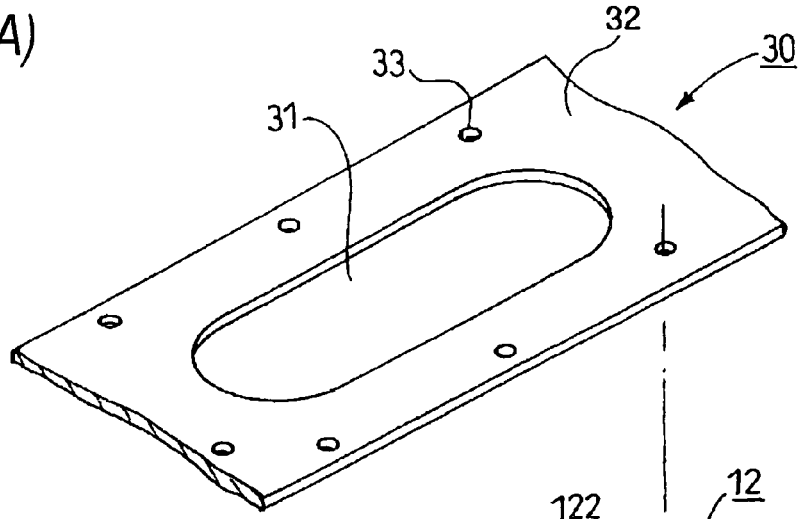
FIG. 10 is an exploded perspective view showing a deep tray container type heater device according to a second embodiment, wherein (A) is a perspective view showing a metal plate from which the evaporation tray portion is hollowed out, (B) is a perspective view showing a heater device, (B1) is a perspective view showing the fixing side to the metal plate and (B2) is a perspective view showing the back side.
Figure 10:
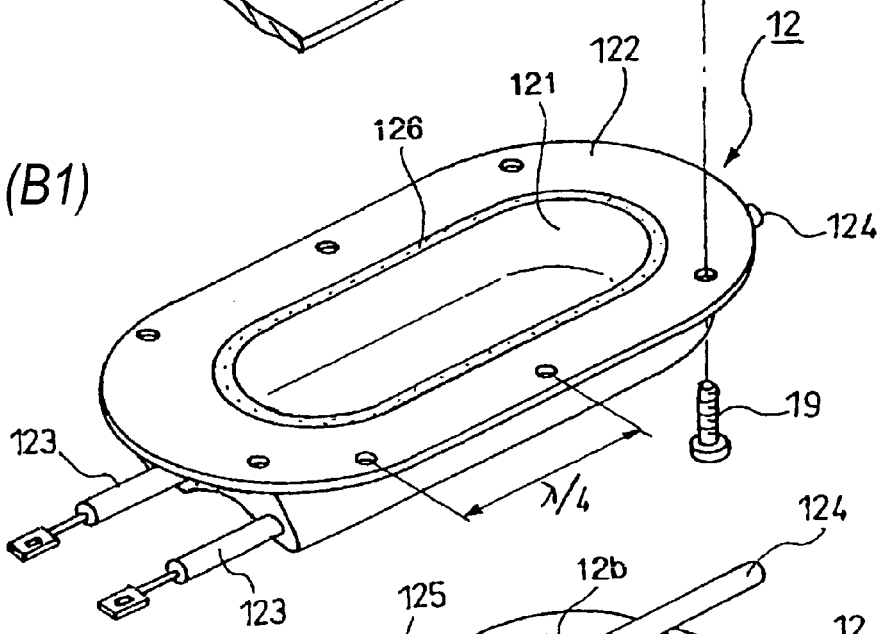
Figure 10:
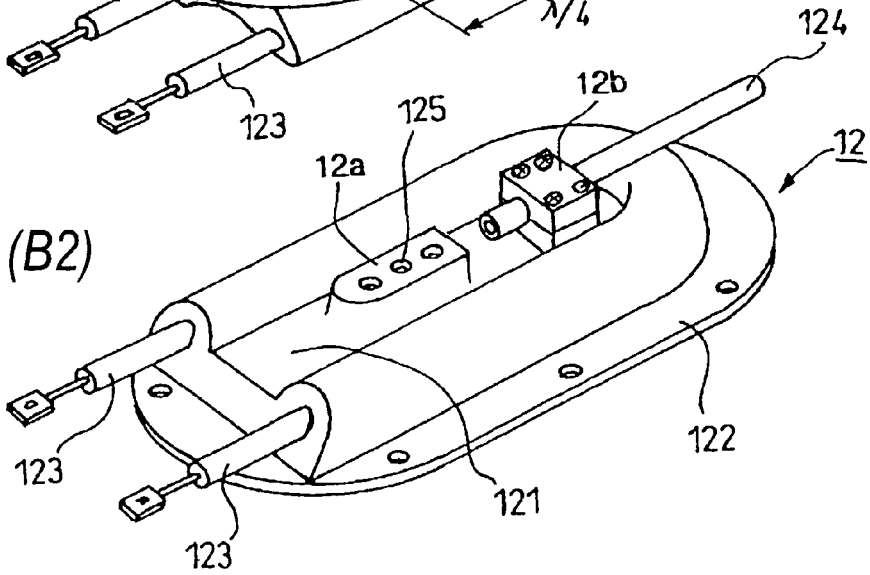

FIG. 10 is an exploded perspective view showing the deep tray container type heater device, wherein (A) is a perspective view showing a metal plate from which an evaporation tray portion is hollowed out, (B) is a perspective view showing the heater device, (B1) is a perspective view showing the fixing side to the metal plate, and (B2) is a perspective view showing the back side.

In (A), 30 represents an evaporation tray support plate provided with a hollow-out portion 31 achieved by hollowing out the portion corresponding to the evaporation tray from the metal plate 32. 126 represents a metal seal and 33 represents a screw hole.

In (B1), 12 represents a heater device formed by aluminum die cast, and it is constructed by the evaporation tray portion 121 corresponding to the hollow-out portion 31 and the fixing portion 122. 123 represents a casted U-shape type sheathed heater, 124 represents a water supply pipe.

In (B2), the same reference numerals as (B1) represent the same elements and thus the description thereof is omitted. In this case, it is understood that the sheathed heater 123 is casted in U-shape.

Furthermore, two boss portions 12*a*, 12*b* are formed at the back side of the aluminum die cast, and an insertion hole 125 in which a thermistor described later is inserted is formed at the first boss portion 12*a* at the left side of the figure.

Furthermore, the water supply pipe 124 described later is fixed to the second boss portion 12*b* at the right side of the figure.

With this construction, heat generated in the sheathed heater 123 is directly thermally transmitted to the evaporation tray 121 in the aluminum die cast, and thus not only the thermal conduction speed is remarkably high as compared with the conventional radiation type heating apparatus 15 based on the pipe heater 13 and the reflection plate 14, but also the thermal conduction loss is more greatly reduced and the steam amount is more greatly increased as compared with the first embodiment shown in (A1) of FIG. 8, so that the water heating speed is higher. Accordingly, the cooking based on steam is more speedy. Furthermore, the apparatus is miniaturized.

When the hollow-out portion 31 of the metal plate 32 and the deep tray container type heater device 12 are combined with each other, if a gap exists between them, electric wave leakage of microwaves might occur from the gap. Therefore, by providing a metal seal 126 around the evaporation tray 121 of the deep tray container type heater device 12, they come into contact with each other at most places, and thus there is little probability that a gap of $\lambda/4$ or more occurs. Accordingly, the electric wave leakage of microwaves can be prevented.

Furthermore, the gap between the screw holes is equal to $\lambda/4$ or less, and thus the electric wave leakage of microwaves can be prevented for the same reason. Furthermore, abnormal overheat or spark due to partial contact can be prevented.

Third Embodiment

Figure 11:
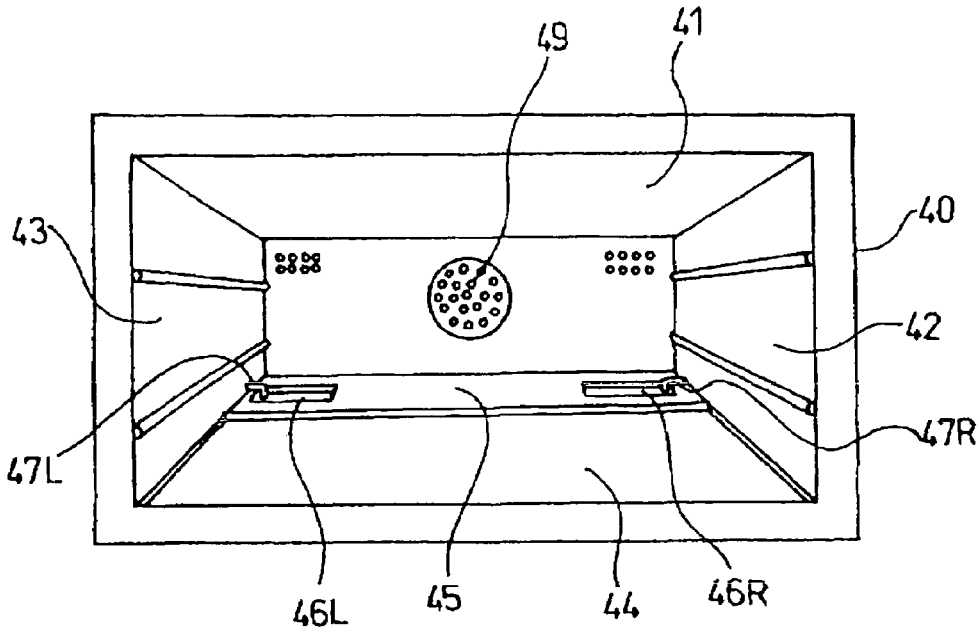
FIG. 11 is a diagram showing the locating positions and number of evaporation plates of the high frequency heating apparatus according to a third embodiment, wherein (a) is a front view showing the state that an opening/closing door of the high frequency heating apparatus is opened, and (b) is a front view showing the positions of the evaporation trays.
Figure 11:
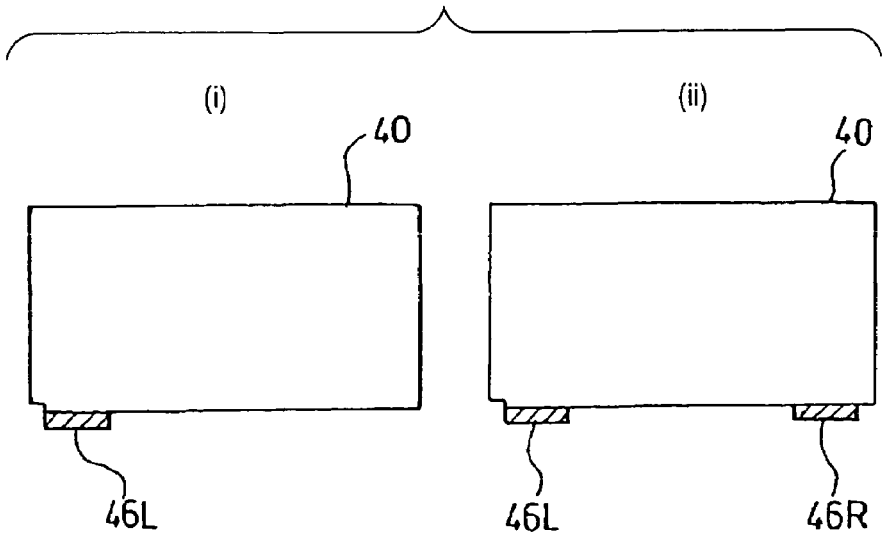

FIG. 11 is a diagram showing the location places and number of evaporation trays in the high frequency heating apparatus according to the present invention, wherein (a) is a front view showing the state that the opening/closing door of the high frequency heating apparatus is opened, and (b) is a front view showing the positions of the evaporation trays.

In 8*a*), 40 represents a high frequency heating apparatus having a steam generating function, 41 represents an upper ceiling in the heating chamber, 42 represents a right side wall, 43 represents a left side wall, 44 represents the bottom surface, 45 represents a metal plate having an evaporation tray, 46R represents a right evaporation tray, 46L represents a left evaporation tray, 47R represents a right water supply port, 47L represents a left water supply port and 49 represents a circulating fan.

As described above, the evaporation tray 46 according to the present invention has large evaporation capability, and thus the evaporation tray is not required to be laid at the back side of the microwave oven so as to cross over in the lateral direction (see 15 of FIG. 1) like the prior art, and it may be provided at one place ((i) of (b)) of right or left corner of the microwave oven as shown in FIG. 11(*b*) or at two places of right and left corners of the microwave oven at the back side as shown in (ii).

In this case, it the evaporation capability having the same level as the prior art is achieved, only one evaporation tray is sufficient.

When a large amount of steam is instantaneously needed in accordance with the type of cooking, it is convenient to provide two evaporation trays. In this case, both the evaporation trays are used, and when steam is not so greatly needed, only one evaporation tray may be used, whereby steam control can be performed. As another using method, one evaporation tray is stopped or intermittently operated while the other evaporation tray is made to carry out a continuous heating operation, thereby adjusting the steam.

Table 2 is a diagrams showing the rate of increase of the weight after heating to the weight before heating by using frozen "shao mai" and "grilled chicken" as cooking targets.

TABLE 2

| | FROZEN SHAO MAI | | GRILLED CHICKEN | |
|---|---|---|---|---|
| | INVENTION | PRIOR ART | INVENTION | PRIOR ART |
| WEIGHT VARIATION RATE (%) | +1.6 | +0.9 | −2.3 | −2.6 |

In table 2, the frozen "shao mai" was subjected to stream based on radiation heat (prior art) and stream based on conductive heat (the present invention) to cook the frozen "shao mai". At this time, the weight variation rate of the prior art was an increase of about 0.9%, however, that of the present invention was an increase of 1.6%. That is, when cooking is carried out by combining the heat of steam evaporated at high speed by conductive heat and electric waves, steam is circulated around and adheres to the surface of foodstuff more early in the chamber as compared with the radiation heat. Therefore, the foodstuff can be heated while supplied with water. Therefore, the amount of water is further increased (1.6% increase) as compared with the increment (0.9% increase) of steam based on radiation heat, so that moist shao mai can be can be made.

Furthermore, with respect to cooling of grilled chicken, the variation rate is a decrease of 2.6% in the prior art, and the variation rate is a decrease of 2.3% in the present invention. That is, when heating is carried out by combining heat of steam evaporated at high speed by conductive heat and the electric waves, steam is circulated around and adheres to the surface of foodstuff more early in the chamber as compared with the conventional apparatus based on radiation heat, and thus drying of the foodstuff due to electric wave heating can be easily prevented, and drying is less (a decrease of 2.3%) than the reduction of the weight (a decrease of 2.6%) due to drying of the conventional apparatus, and thus dry feeling can be more greatly suppressed.

As described above, according to the present invention, the heating time can be shortened as compared with the prior art, and the heating based on electric waves can be shortened. Accordingly, the time required to evaporation of water from a cooking target is also reduced, the reduction of the water from the target is suppressed.

Fourth Embodiment

Figure 12:
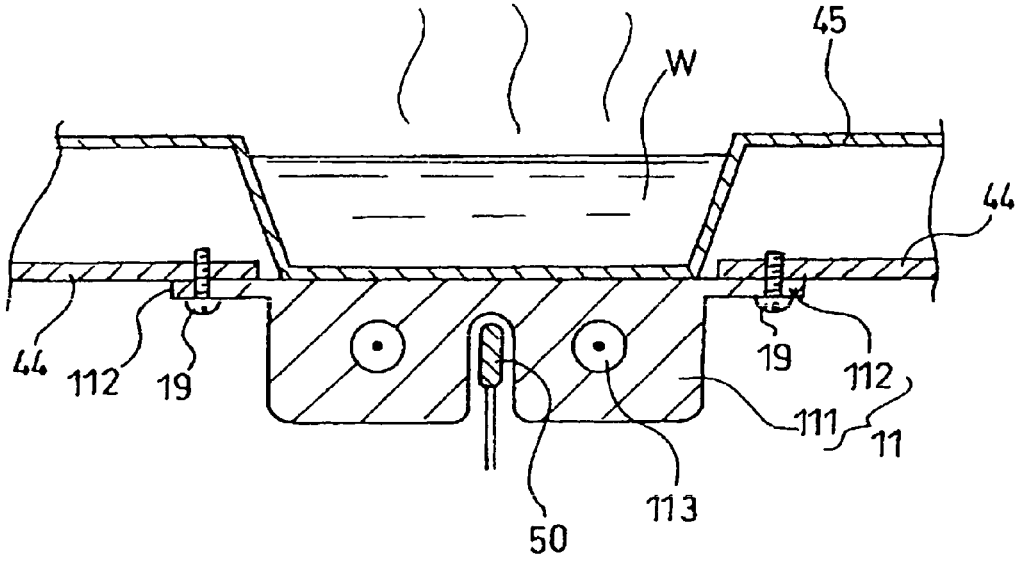
FIG. 12 is a longitudinally-sectional view showing the periphery of a heater device according to a fourth embodiment.

FIG. 12 is a longitudinally cross-sectional view showing the periphery of a heater device according to a fourth embodiment. In the fourth embodiment, the control under abnormality when water is wasted on the evaporation tray is also carried out in addition to the normal temperature control (the control of the evaporation amount) that the temperature of the heater device (aluminum die cast) itself is detected by the thermistor embedded at the center of the hater, and if the detection value exceeds a predetermined value, power supply to the heater device is stopped. Specifically, the power supply to the heater device may be stopped when the thermistor is set to off-level sequentially twice or at a predetermined higher number of times, thereby stopping steam heating. With this construction, the overheat control under abnormality can be rapidly performed. The overheat protecting operation is as follows.

Figure 13:
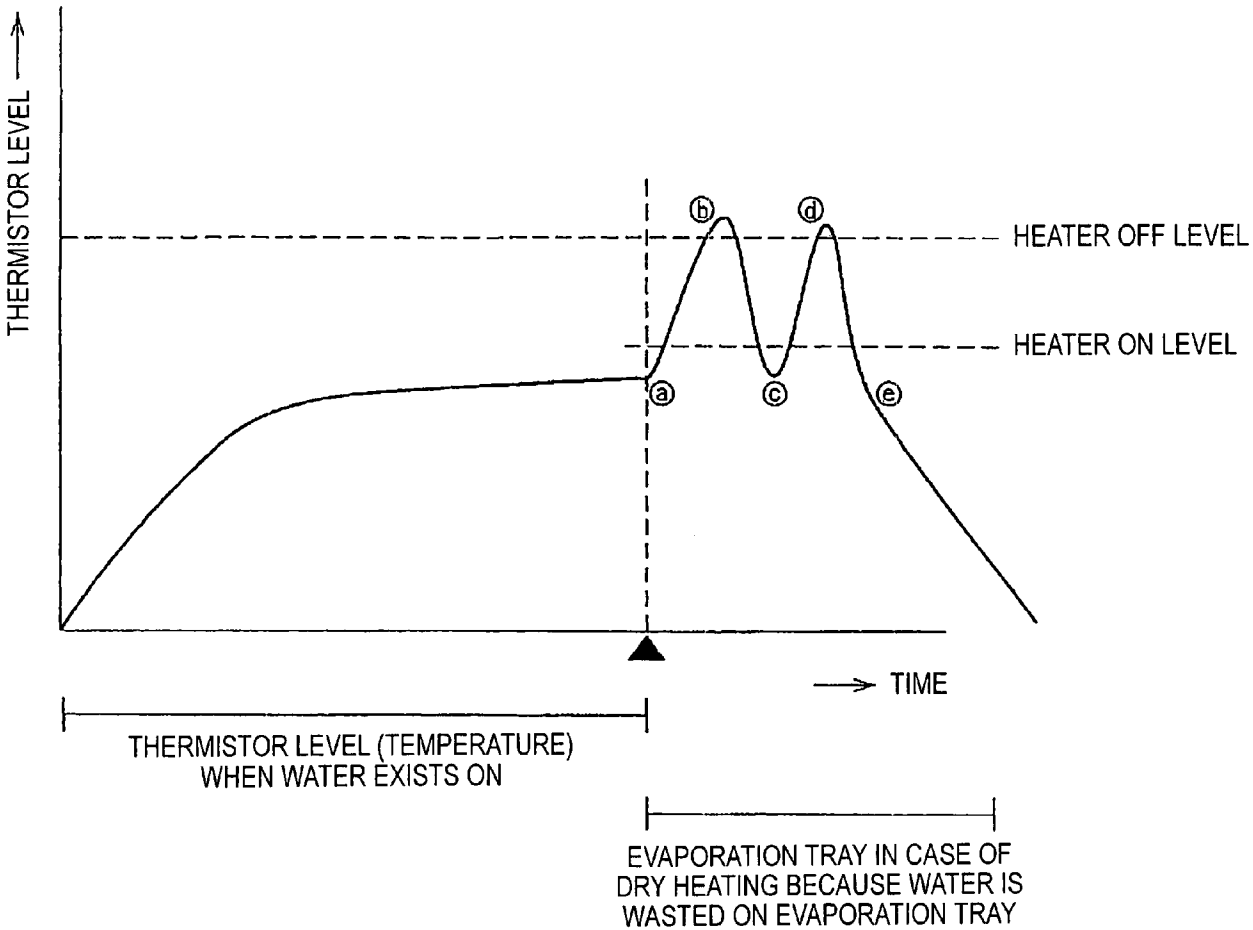
FIG. 13 is a diagram showing an operation of protecting from overheat caused by dry heating according to the present invention.

FIG. 13 is a diagram showing the operation of protecting from overheat caused by dry heating according to the present invention.

As shown in FIG. 13, when water is supplied from the water tank and fully filled on the water supply tray 45, the detection temperature level of a thermistor 50 (FIG. 12) is increased in connection with the temperature increase of the heating means 113. However, when there is no water on the water supply tray indicated by a symbol a in FIG. 13, the detection temperature level is rapidly increased because power supply to the heating means 113 is carried out, and thus the detection temperature level exceeds an upper limit reference value indicated by b.

A control circuit (not shown) interrupts current supply to the heating means 113 at the time point when the detection temperature level exceeds the upper limit reference value. At this time point, the detection temperature level of the thermistor 50 decreases although there is some overshoot. Finally, at the time point when the detection temperature level of the thermistor 50 reaches a lower limit value indicated by c, the control circuit carries out current supply to the heating means 113 again to heat the heater. However, since no water exists on the water supply tray 45, the detection temperature level of the thermistor 50 is increased again, and exceeds the upper limit reference value indicated by d. At this time point, the control circuit judges that no water exists on the water supply tray 45 and thus the heating means is under a dry heating state, and it interrupts current supply to the heating means 113 and emits an alarm as indicated by e, thereby carrying out the control of stopping the steam heating treatment.

In this embodiment, the control of the generated steam amount and the abnormality detection when water is wasted on the evaporation tray can be carried out by a single thermistor.

Furthermore, by the above control, the lifetime of the heater and the use of the evaporation tray within the heat-resistance temperature are enabled, and deterioration of the fluorine-resin coated surface of the evaporation surface can be prevented.

The mount position of the thermistor is set to the center between the two long axes of the U-shaped sheathed heater, and also in order to accurately detect the temperature of the evaporation tray 45, a hole 111*a* is formed in the aluminum die cast 111 so as to face the evaporation tray 45 and the thermistor 50 is put in the hole 11*a*.

In FIG. 12, the heater device of FIG. 9 is used. However, it is needless to say that the heater device of FIG. 10 provides the same effect.

When a pumpless system based on a siphon is adopted, the heater device in which the water supply pipe is fixed to the aluminum die cast as shown in FIG. 9 or 10 may be used.

Figure 14:
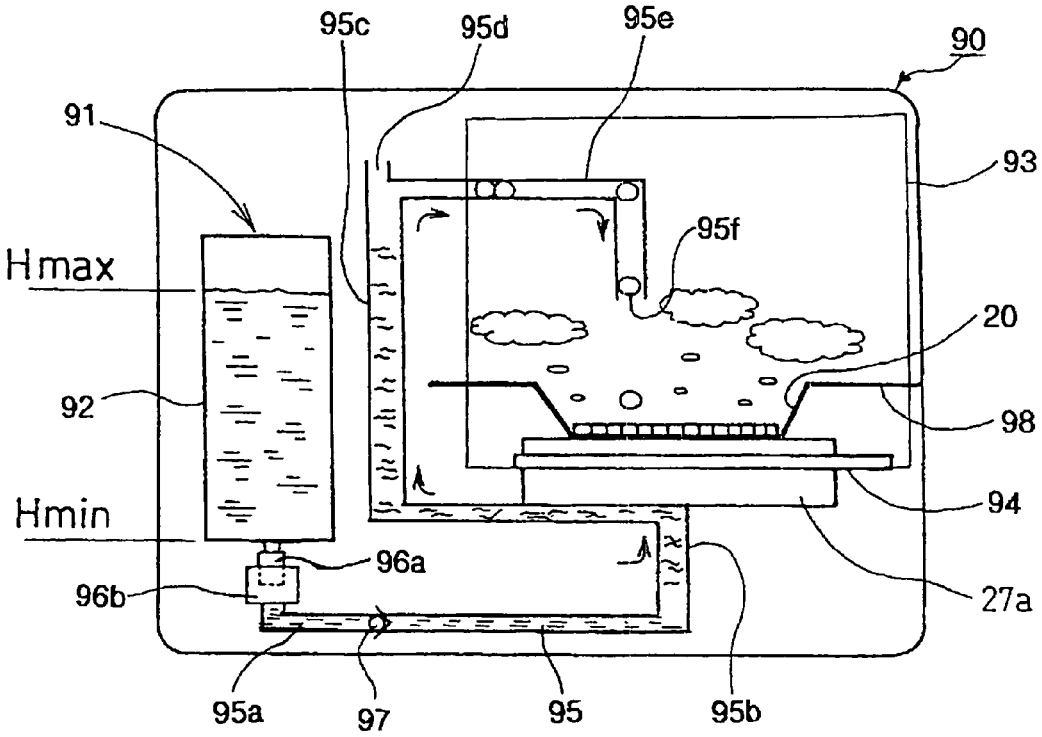
FIG. 14 is a diagram showing the construction of a steam supply mechanism when one water supply tray is provided.

FIG. 14 is a diagram showing the operation of the pumpless system based on the siphon.

In FIG. 14, the steam supply mechanism 91 comprises one water tank 92 which is detachably secured to the apparatus main body 90, two metal evaporation trays 20 mounted in a heating chamber 93, a heater device 94 for heating the metal evaporation trays 20 and evaporate water on the metal evaporation trays 20, a water supply path 95 for leading the water of the water tank 92 through a heating area based on the heater device 94 to the evaporation tray 20, a tank-side waterproof valve 96*a* and a water supply path side waterproof valve 96*b* that are provided to the connection portion between the water tank 92 and the water supply path 95 and prevent leakage of water in the water tank 92 and the water supply path 95 when the water tank 92 is detached, and a check valve 97 that is disposed at the downstream side of the water supply path side waterproof valve 96*b* and prevents back flow of water from the water supply path 29 to the water tank 92.

The water supply path 95 comprises a base end pipe portion 95*a* connected to the connection port 22*b* of the water tank 92, a horizontal pipe portion 95*b* laid below the bottom plate 98 of the heating chamber 93 so as to pass from the base end pipe portion 95*a* through the heating area based on the heater device 94, a vertical pipe portion 95*c* erecting vertically from the tip of the horizontal pipe portion 95*b* along the side of the heating chamber 93, an upper pipe portion 95*e* extending from the upper end of the vertical pipe portion 95*c* to the upper side of the water supply tray 45 and dropping wafer fed from the vertical pipe portion 95*c* under pressure onto the water supply tray 45, an air take-in port 95*d* and a water blow-out port 95*f* forming the tip of the upper pipe portion 95*e*.

The horizontal pipe portion 95*b* is laid so as to come into contact with the aluminum die cast 94*a* of the heater device 94, the heat of the heater device 94 is rapidly transmitted, and the water in the horizontal pipe portion 95 is expanded and supplied to the evaporation tray 94.

Here, the principle of occurrence of steam will be described in detail.

When the heater device 94 generates heat under the state that the water tank 92 is inserted in the tank accommodating portion 35 and water is filled in the horizontal pipe portions 95*b*, 95*b*, heat is transmitted to the water in the pipes at the contact portions, so that the water is expanded.

The check valve 97 temporarily stops the pressure of the expanding water in the pipes, and thus the pressure is directed to the vertical pipe portion 95*c*, so that the expanding water passes through the upper pipe portion 95*e* to be dropped from the water blow-out port 95*f* and supplied onto the evaporation tray 20.

The base pipe portion 95*a* is equipped with the pipe-side waterproof valve 96*b* for preventing water leakage from the horizontal pipe portion 95*b* side when the water tank 92 is detached, and the check valve 47 for preventing back flow from the horizontal pipe portion 95*b* side due to expansion of water in the horizontal pipe portion 95*b* is equipped at the connection portion with the horizontal pipe portion 95*b*.

As shown in FIG. 14, the upper end of the vertical pipe portion 95*c* to which the upper pipe portion 95*e* is connected is located at a position higher than the maximum level position Hmax of the stocked water in the water tank 92. This is to prevent the water stocked in the water tank 92 side form carelessly and continuously flowing out to the upper pipe portion 95*e* by an intercommunicating tube action.

Furthermore, the water supply path 95 is connected to the water tank 92 through the base end pipe portion 95*a* at a position which is further lower than the minimum level Hmin of the stocked water in the water tank 92. This is to enable all the water stocked in the water tank 92 to be taken to the water supply path 95 side.

The water supplied to the evaporation tray 20 is kept to be increased in temperature because of the heat generated by the heater device 94, and thus the time required from the supply of water to the evaporation tray 20 until occurrence of steam can be shortened, and the steam heating can be rapidly performed.

If the heating is interrupted, the water in the vertical pipe portion 95*c* of the water supply path 95 does not expand. Therefore, the water cannot reach the air intake port 9*b*, and the atmospheric pressure invades from the air take-in port 95*d*, so that the water supply is stopped.

Furthermore, in the above construction, when the residual amount of the water tank 92 is equal to 0 (zero) and the residual water amount on the evaporation tray is reduced, the quantity of heat to be consumed by evaporation of water is reduced, and thus the temperature of the heater device 94 and the evaporation tray 20 itself is increased. However, since the steam supply mechanism 91 of this embodiment is equipped with the thermistor 50 for detecting the temperature of the heater device 94 as described above, it is possible to detect the residual amount 0 of the water tank 92 relatively easily by monitoring the detection signal of the thermistor 50, and occurrence of disadvantages such as dry heating, etc. can be prevented.

Furthermore, by using the detection signal of the thermistor, various control operations such as the control operation of stopping the operation of the heater device 94, emitting an alarm for water supply, etc. can be performed when the residual amount 0 of the water tank 92 is detected, and the handling performance of the high frequency heating apparatus 100 can be enhanced.

The foregoing description is applied to the case where one evaporation tray of (i) of (b) of FIG. 11 is provided, and the same principle is applied to a pumpless siphon when two evaporation trays of (ii) are provided. However, in this case, if the water supply paths 95 equipped to the evaporation trays 20 are designed so that the distance from the contact portion of the heater to the water blow-out port of the tip of the pipe is equal between both the water supply paths 95, the supply amounts of the water supply paths 95 can be made coincident with each other, and uniform supply of heating steam in the heating chamber 93 can be implemented in low cost.

As described above, when current is supplied to the sheathed heater, the aluminum die cast is rapidly heated, and the water in the water supply pipe is also rapidly heated to expand. The water thus expanding passes through the atmospheric pressure take-in port 95*d*, and finally reaches the water supply port provided at a position lower than the reference water level, so that the siphon operation is started and the water from the water tank is supplied from the water supply port at the tip of the water supply pipe onto the evaporation tray. The water supply is continued while heating is carried out. When the heating is interrupted, the water in the water supply pipe does not expand. Accordingly, the water does not reach the air take-in port 95*d*, and the atmospheric pressure enters from the air take-in port 95*d* into the pipe and the water supply is stopped.

As described above, if the heater device according to the present invention shown in FIG. 9 or 10 is used, rapid high-temperature heating can be performed, and the water in the water supply pipe can rapidly and greatly expand, so that the pumpless driving using the siphon can be first performed.

Fifth Embodiment

Figure 15:
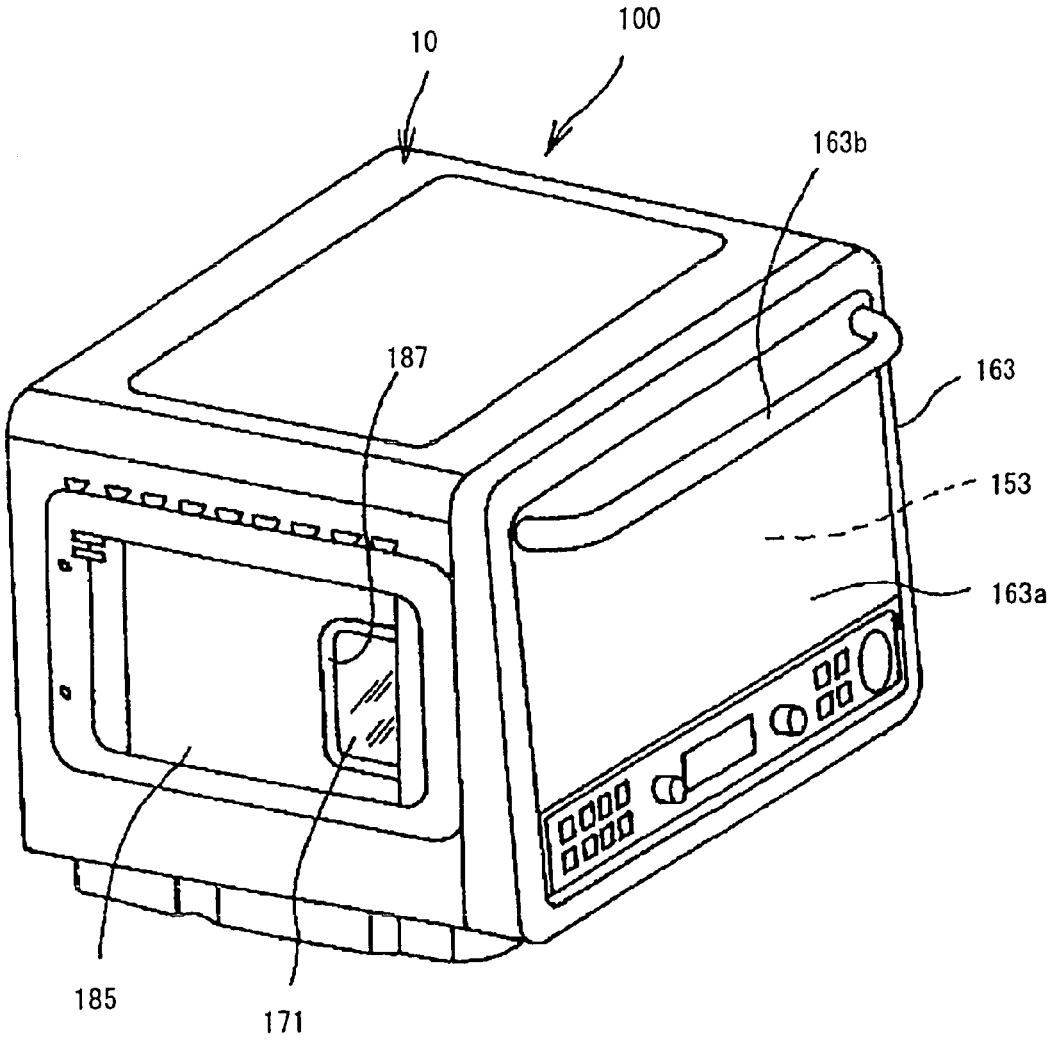
FIG. 15 is a perspective view showing the outlook of a first embodiment of a high frequency heating apparatus having a steam generating function according to the present invention.
Figure 16:
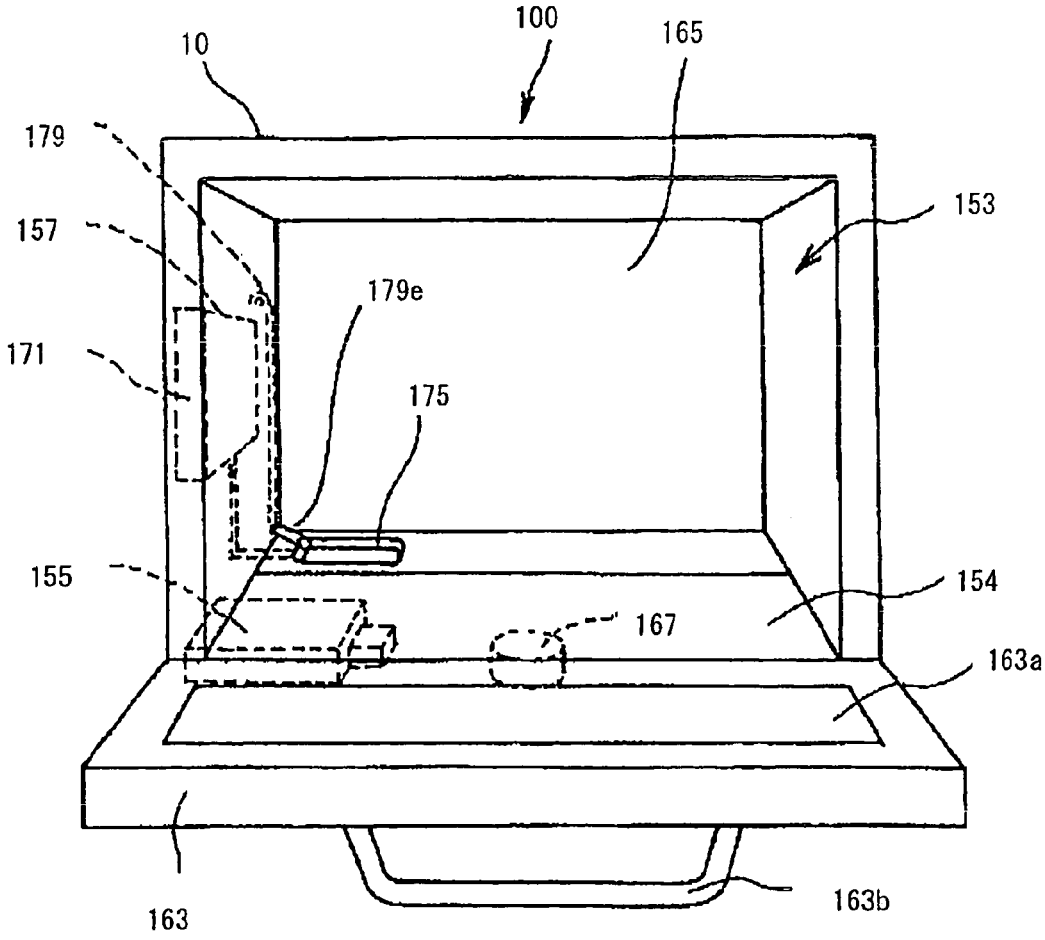
FIG. 16 shows the state that the opening/closing door of a heating chamber of the high frequency heating apparatus having the steam generating function shown in FIG. 15 is opened, and also is a diagram showing the construction when the inside of the heating chamber is viewed from the front side.

FIGS. 15 and 16 are diagrams showing the outlook of an embodiment of the high frequency heating apparatus having the steam generating function according to the present invention.

The high frequency heating apparatus 100 having the steam generating function according to the embodiment is used as a microwave oven which can perform high frequency heating and heating based on heating steam to cook foodstuff, and equipped with high frequency wave generating means (magnetron) 155 for outputting high frequency waves into a heating chamber 153 in which a heating target such as foodstuff or the like is accommodated, and a steam supply mechanism 157 for supplying heating steam into the heating chamber 153. It supplies at least one of the high frequency waves and the heating steam into the heating chamber 153 to cook the heating target in the heating chamber 153.

The heating chamber 153 is formed in a box-shaped main body case 10 which is opened at the front side thereof, and an opening/closing door 163 having a light transmissible window 163*a* for opening/closing the heating target take-out port of the heating chamber 153 is provided at the front side of the main body case 10. The opening/closing door 163 is joined to the lower edge of the main body case 10 at the lower end thereof through a hinge, so that the opening/closing door 163 can be opened/closed in the vertical direction. By grasping a knob 163*b* equipped at the upper portion and pulling forwardly, the opening/closing door 163 can be set to an open state shown in FIG. 16.

An adiabatic space can be secured between the wall surface of the heating chamber 153 and the wall surface of the main body case 10, and an adiabatic material is filled in the space as occasion demands.

Particularly, the space at the back side of the heating chamber 153 is a circulating fan room in which a circulating fan for stirring the atmosphere in the heating chamber 153 and a driving motor (not shown)for the circulating fan are accommodated, and the wall of the rear surface of the heating chamber 153 serves as a partition wall through which the heating chamber 153 and the circulating fan room are compartmented from each other.

As not shown, air suction vent holes for sucking air from the heating chamber 153 side to the circulating fan room side and air blowing vent holes for blowing air from the circulating fan room side to the heating chamber 153 side are provide while the formation areas thereof are discriminated from each other. The respective vent holes are formed as many punch holes.

In this embodiment, as shown in FIG. 16, the high frequency wave generating means (magnetron) 155 is disposed in a space below the heating chamber 153, and a stirrer vane 167 is provided at a position where high frequency waves generated from the high frequency heating apparatus 155 are received. By irradiating the high frequency waves from the high frequency generating means 155 to the rotating stirrer vane 167, the high frequency waves are supplied into the heating chamber 153 while stirred by the stirring vane 167. The locating positions of the high frequency generating means 155 and the stirrer vane 167 are not limited to the bottom portion of the heating chamber 153, and they may be provided at the upper surface side or side surface side of the heating chamber 153.

Figure 17:
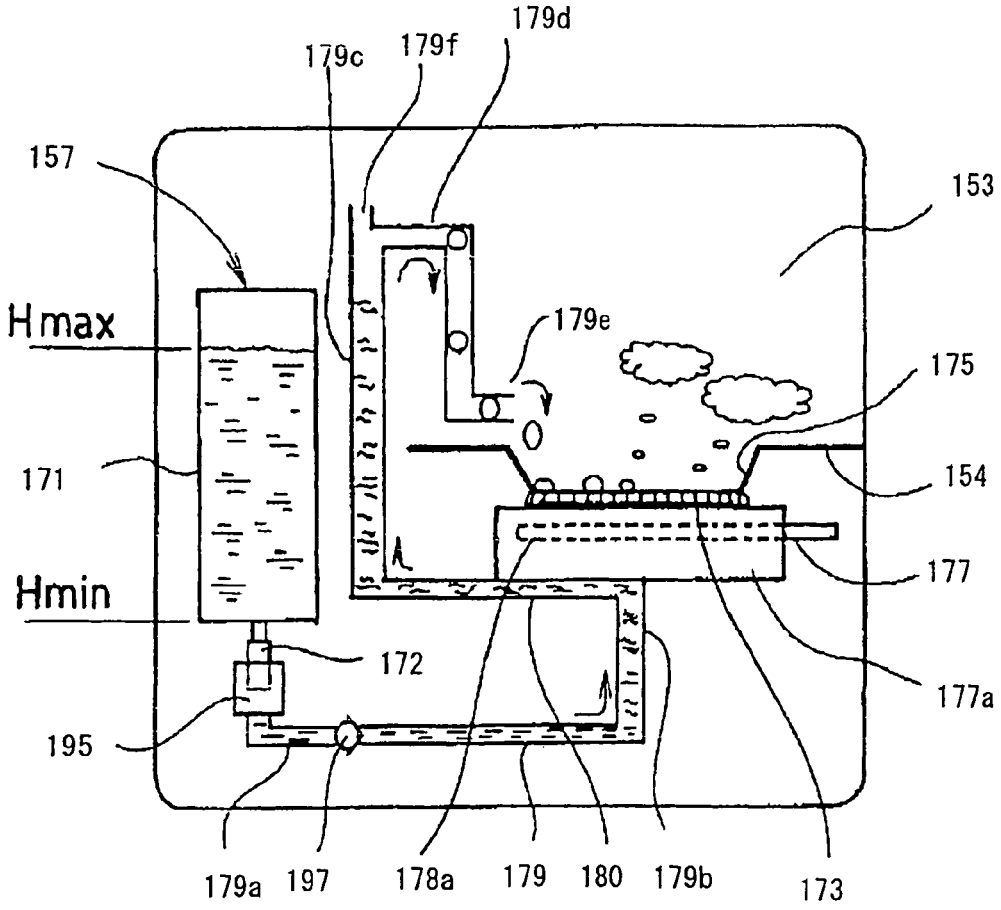
FIG. 17 is a diagram showing the construction of a steam supply mechanism of the high frequency heating apparatus having the steam generating function shown in FIG. 15.

As shown in FIG. 17, the steam supply mechanism 157 comprises a water tank 171 which is detachably equipped to the main body of the apparatus, a water supply tray 175 provided in the heating chamber 153, heating means 177 for heating the water supply tray 175 to evaporate water on the water supply tray 175, a tray electric heating member 173 for transmitting heat of the heating means 177 to the water supply tray 175, a water supply path 179 for leading the water of the water tank 171 through the heating area based on the heating means 177 to the water supply tray 175, a tank-side connection port 172 and a water supply path side waterproof valve 195 which are equipped to the connection portion between the water tank 171 and the water supply path 179 to prevent leakage of water in the water tank and the water supply path when the water tank 171 is detached, and a check valve 197 that is disposed at the downstream side of the waterproof valve 195 at the water supply path side to prevent back flow of water from the water supply path 179 to the water tank 171.

The steam supply mechanism 157 is designed so that the water supply path 179 of one system is provided, however, it may be designed so that water is supplied from plural water supply paths to plural water supply trays to generate steam.

In this embodiment, the water tank 171 is designed as a planular rectangular parallelepiped cartridge type having excellent handling performance, and it is inserted and mounted in a tank accommodating portion 185 assembled on the side surface of the main body case 10 as shown in FIG. 15 so that it is easily detached from and mounted on the main body of the apparatus (main body case 10) and also it is hard to be thermally damaged by the heat in the heating chamber 153.

Figure 21:
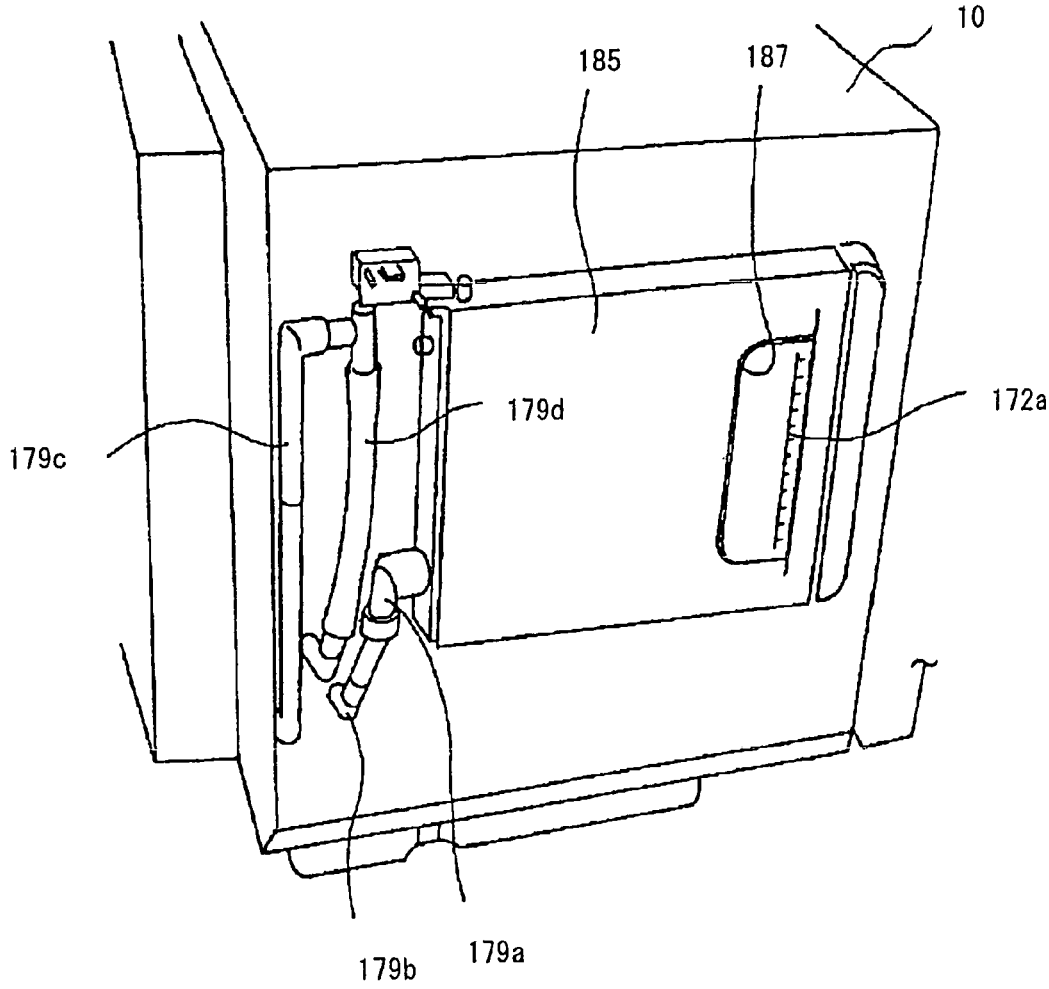
FIG. 21 is a diagram showing a fixing structure at the side surface of the apparatus of the steam supply mechanism shown in FIG. 17.

The water tank 171 is formed of transparent resin so that the residual amount of water in the water tank 171 can be visually recognized, and scale markings indicating the water level of the residual water are provided on both the side surfaces of the water tank 171. The site at which the scale markings 172*a* are provided are set so that the scale markings 172*a* are exposed to the outside through a cut-out window 187 formed at the front end edge of the tank accommodating portion 185 as shown in FIG. 21, and the residual amount of water in the water tank 171 can be visually recognized from the outside.

Figure 18:
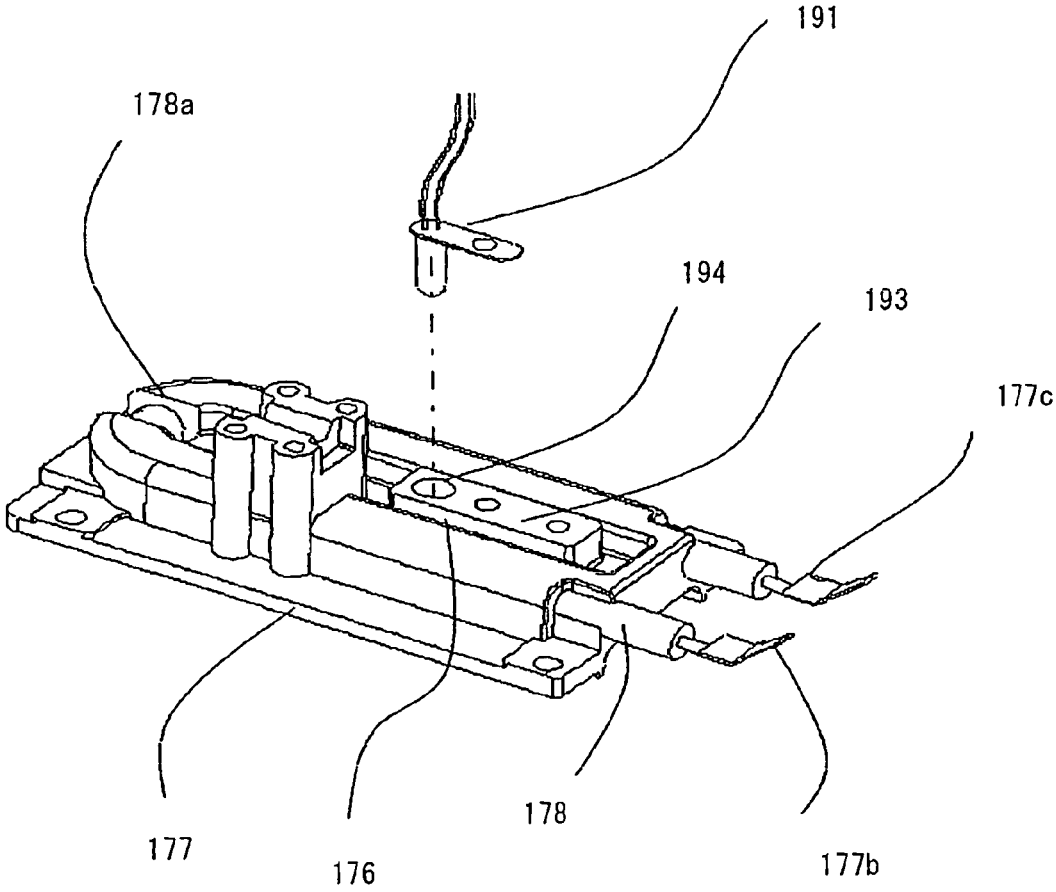
FIG. 18 is a diagram showing the construction of heating means of the steam supply mechanism.

As shown in FIG. 18, the heating means 177 is designed so that a sheathed heater 178 having an U-bent portion 178 bent substantially in U-shape is assembled with an assembly block 177*a* of aluminum die cast. It can be designed in a small size even when the heater has a relatively high output power and the water supply tray 175 can be also designed in a small size, so that there can be prevented occurrence of unevenness of heating which would occur when there exist both a place to which water is supplied and a place to which no water is supplied.

The water supply tray 175 of this embodiment is constructed by forming a recess for receiving supplied water at a part of the bottom plate 154 of the heating chamber 153, and it is integral with the bottom plate 154.

The heating means 177 is the sheathed heater disposed in contact with the lower surface of the water supply tray 175, and designed so that the heater main body is assembled in the assembly block 177*a* formed of an aluminum die cast which is secured to the back surface of the water supply tray 175 under close contact. In the case of this embodiment, a thermistor 191 serving as a temperature detecting sensor for detecting the temperature of the heating means 177 is connected between a pair of electrodes 177*b* and 177*c* at both the ends of the heater extending from the assembly block 177*a*. As shown in FIG. 18, the heating means 177 is provided with a thermistor mount block 193 having an insertion hole 194 in which the thermistor 191 is inserted, and a slid portion 176 is formed around the thermistor mount block 193.

Figure 19:
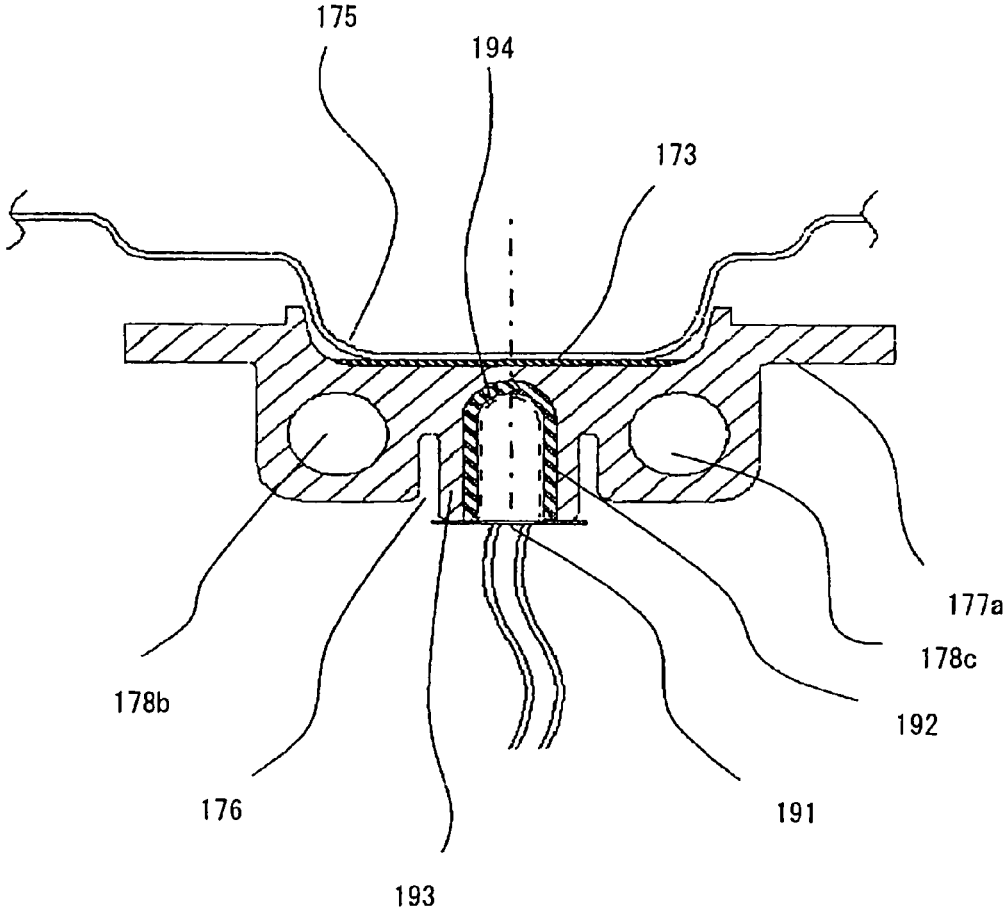
FIG. 19 is a cross-sectional view showing a fixing structure of the heating means shown in FIG. 18.

As shown in FIG. 19, the thermistor 191 is provided so as to be embedded in the insertion hole 194 of the thermistor mount block 193 between the straight tube portions 178*b*, 178*c* of the sheathed heater. A thermistor heat transmission material 192 is embedded in the insertion hole 194, and it can rapidly transmit the temperature of the thermistor mount block 193 to the thermistor 191. Furthermore, the slit portion 176 is formed around the thermistor mount block 193, so that the heat of the sheathed heater 178*b*, 178*c* is hardly transmitted to the thermistor mount block 193 and thus the thermistor is liable to be affected by the temperature of the water supply tray 175. Furthermore, the water supply tray heat transmission material 173 is sandwiched between the water supply tray 175 and the mount block 177*a*. Therefore, the heat of the mount block 177*a* is easily transmitted to the water supply tray 175, so that not only the occurrence efficiency of steam can be increased, but also variation of heat when water is wasted on the water supply tray 175 and thus the temperature of the water supply tray 175 is increased can be surely transmitted to the thermistor 191. The detection signal of the thermistor 191 is monitored by a control circuit (not shown), and it can be used for the residual amount 0 detection of the water tank 171 and the operation control of the heating means 177 (the control of the quantity of heat).

As shown in FIG. 13, when water is supplied from the water tank 171 and filled in the water supply tray 175, the detection temperature level of the thermistor 191 increases in connection with the temperature increase of the heating means 171. However, when water is wasted on the water supply tray 175 as indicated by a symbol a, no current is supplied to the heating means 171, so that the detection temperature level rapidly increases and exceeds an upper limit reference value indicated by a symbol b.

The control circuit (not shown) interrupts current supply to the heating means 171 at the time point when the detection temperature level exceeds the upper limit reference value.

At this time point, the detection temperature level of the thermistor 191 decreases although there is some overshoot. Finally, at the time point when the detection temperature level of the thermistor 191 reaches the lower limit reference value indicated by c, the control circuit carries out current supply to the heating means 171 again to heat the heater. However, since there is no water on the water supply tray 175, the detection temperature level of the thermistor 191 increases again, and exceeds the upper limit reference value indicated by d. At this time point, the control circuit judges that no water exists on the water supply tray 175 and the heating means 171 is under a dry heating state, and it interrupts current supply to the heating means 171 as indicated by e and emits an alarm to stop the steam heating treatment.

In this embodiment, as described above, the generation control of the steam amount and the detection of abnormality occurring when water is wasted on the water supply tray can be detected by a single thermistor.

Furthermore, the above control can enables increase of the lifetime of the heater and the use of the water supply tray within the heat-resistance temperature, whereby the fluorine resin coated surface of the water supply tray can be prevented from being deteriorated.

In this embodiment, when the cycle of turning on and off the heater is repeated and the thermistor detects the temperature corresponding to the upper limit reference value twice, it is judged that there is no water on the water supply tray. However, the detection frequency is not limited to twice, and it may be judged by detecting the temperature concerned at plural times.

Figure 20:
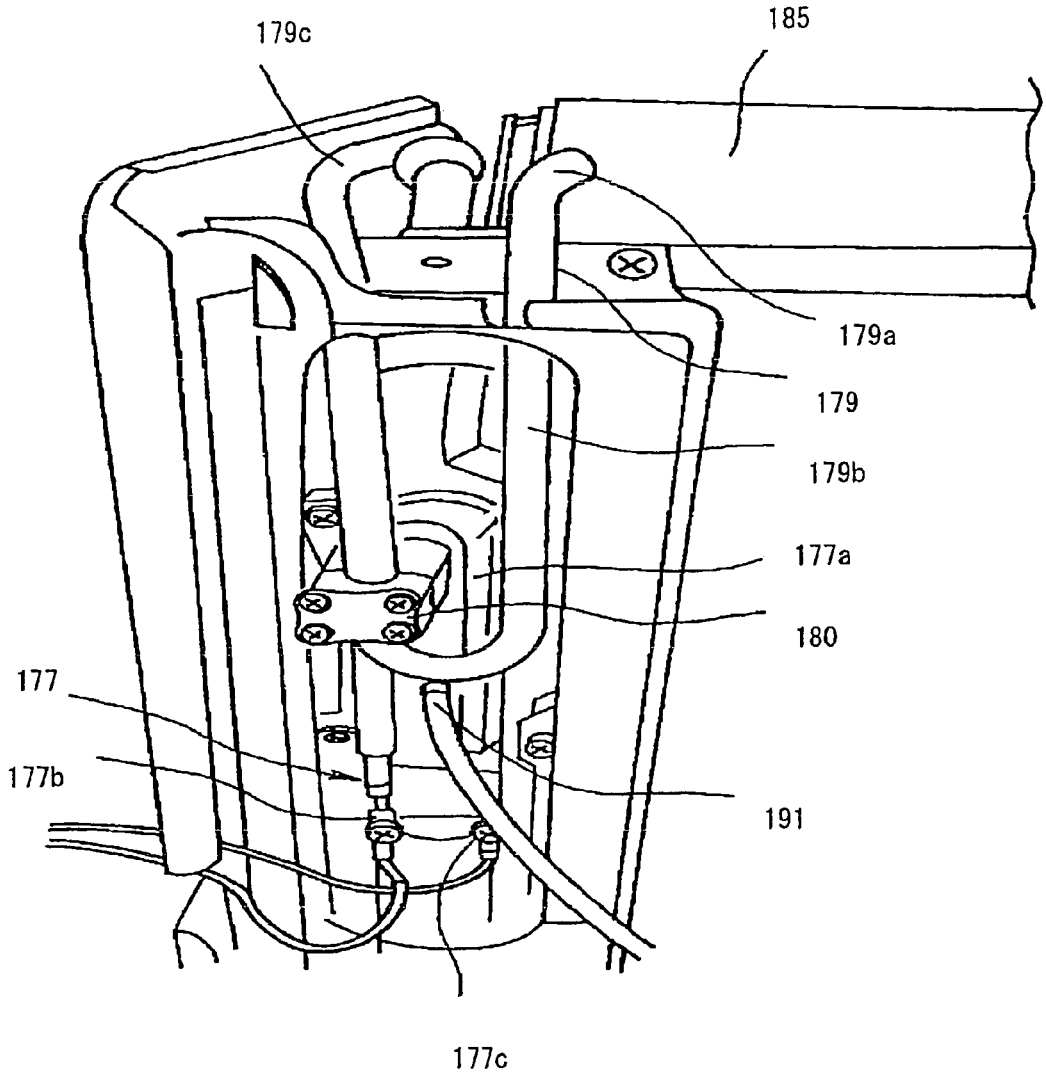
FIG. 20 is a diagram showing a construction that a water supply path is heated by heating means disposed at the bottom portion of the apparatus.

As shown in FIGS. 17, 20 and 21, the water supply path 179 comprises a base end pipe portion 179*a* which is connected to the connection port 172 of the water tank 171, a horizontal pipe portion 179*b* laid below the bottom plate 154 of the heating chamber 153 so as to pass from the base end pipe portion 179*a* through the heating areas based on the heating means 177, a vertical pipe portion 179*c* erecting vertically from the tip of the horizontal pipe portion 179*b* along the side of the heating chamber 153, an upper pipe portion 179*d* that extends upwardly from the upper end of the vertical pipe portion 179*c* to the upper side of the water supply tray 175 and drops water fed from the vertical pipe portion 179*c* under pressure to the water supply tray 175, and a water supply nozzle 179*e* forming the tip of the upper pipe portion 179*d*.

As shown in FIG. 17, the horizontal pipe portion 179*b* is laid so as to come into contact with the assembly block 177*a* of the heating means 177, and the contact portion 180 thereof with the assembly block 177*a* shown in FIG. 20 served as the heating area based on the heating means 177.

In this embodiment, the horizontal pipe portion 179*b* of the water supply path 179 is set as the heating area based on the heating means 177, and water in each horizontal pipe portion 179*b* which is thermally expanded through the thermal conduction of heat generated by each heating means 177 is supplied to each water supply tray 175.

The situation that steam occurs will be described in detail. When the heating means 27 heats under the state that the water tank 171 is inserted in the tank accommodation portion 185 and water is filled in the horizontal pipe portions 179*b*, water in the pipe is heated at the contact portion 180 with the assembly block 177*a* and thermally expands. The check valve 197 temporarily stop the pressure of the expanding water in the pipe, and thus the pressure of the water directs in only the direction to the vertical pipe portion 179*c*. Then, the expanding water passes through the upper pipe portion 179*d*, and drops from the water supply nozzle 179*e* to the water supply tray 175. The water supply nozzle 179*e* is provided at the upper side of the U-bent portion 178*a* which is bent substantially in U-shape in the sheathed heater 178, and water is dropped to the water supply tray 175 above the bent site at which the temperature is liable to be relatively high, so that the time required from the water supply to the water supply tray 175 till occurrence of steam can be shortened.

Furthermore, the water supplied to the water supply tray 175 is kept to be increased in temperature by the heat generated in the heating means 177, so that the time required from the water supply to the water supply tray 175 till occurrence of steam can be shortened and the rapid steam heating can be performed If heating is interrupted, the water in the vertical pipe portion 179*c* of the water supply path 179 does not expand, and thus the water does not reach the air take-in port 179*f*, so that the atmospheric pressure enters from the air take-in port 179*f* into the pipe and water supply is stopped.

As shown in FIG. 17, the upper end of the vertical pipe portion 179*c* to which the upper pipe portion 179*d* is connected is set at a position higher than the maximum level position $H_{max}$ of the water stocked in the water tank 171. This is to prevent the stocked water at the water tank 171 side from carelessly and continuously flowing out to the upper pipe portion 179*d* side by the intercommunicating pipe action, Furthermore, the water supply path 179 is connected to the water tank 171 through the base end pipe portion 179*a* at a position lower than the minimum level Hmin of the water stocked in the water tank 171.

This is to enable all the water stocked in the water tank 171 to be taken to the water supply path 179 side.

In the high frequency heating apparatus having the steam generating function described above, the heating means 177 is designed so that the sheathed heater 178 having the U-bent portion 178*a* which is bent substantially in U-shape is assembled with the assembly block 177*a* of aluminum die cast, and it can be designed in a compact size even when the heater has relatively high output power, and the water supply tray 175 can be also designed in a compact size. Accordingly, it can be prevented that there occur both a place to which water is supplied and a place to which no water is supplied and thus unevenness of heating occurs.

Furthermore, the water supply nozzle 179*e* is provided at the upper side of the U-shaped bent U-bent portion 178*a* of the sheathed heater 178 and water is dropped and supplied to the water supply tray 175 at the bent site at which the temperature is liable to be relatively high, and thus the time required from the water supply to the water supply tray 175 till occurrence of steam can be shortened. Furthermore, the water supplied to the water supply tray 175 is kept to be increased in temperature by the heat generated in the heating means 177, so that the time required from the water supply to the water supply tray 175 till occurrence of steam can be shortened and the rapid steam heating can be performed.

Still furthermore, in the above construction, when the residual amount of the water tank 171 is equal to zero (zero) and thus the residual water amount on the water supply tray 175 is reduced, the quantity of heat to be consumed by evaporation of water is reduced, so that the temperature of the heating means 177 or the water supply tray 175 itself increased.

However, since the steam supply mechanism 157 of this embodiment is equipped with the thermistor 191 for detecting the temperature of the heating means 177, the residual amount 0 detection of the water tank 171 can be performed relatively simply by monitoring the detection signal of the thermistor 191, and occurrence of a disadvantage such as dry heating or the like can be prevented. The heating means 177 is provided with the thermistor mount block 193 having the insertion hole d194 in which the thermistor 191 is inserted, and the slit portion 176 is formed around the thermistor mount block 193. Therefore, the heat of the sheathed heater is hardly transmitted to the thermistor mount block 193, and the thermistor is liable to be affected by the temperature of the water supply tray 175, so that the detection precision of the dry heating can be enhanced. Furthermore, the thermistor heat transmission material 192 is embedded in the insertion hole 194 of the thermistor 191 so that the temperature of the thermistor mount block 193 can be rapidly transmitted to the thermistor 191. Furthermore, the tray electric heat material 173 is sandwiched between the water supply tray 195 and the mount block 197*a*. Not only it makes it easy to transmit the heat of the mount block 177*a* to the water supply tray 175 to thereby increase the generation efficiency of steam, but also the variation of heat when water is wasted on the water supply tray 175 and the temperature thereof is increased can be surely transmitted to the thermistor 41.

Furthermore, use of the detection signal of the thermistor enables various kinds of control such as the control of stopping the operation of the heating means 177, the control of emitting an alarm or the like, for example when the residual amount 0 of the water tank 171 is detected, and the handling performance of the high frequency heating apparatus 100 can be enhanced.

Sixth Embodiment

Figure 24:
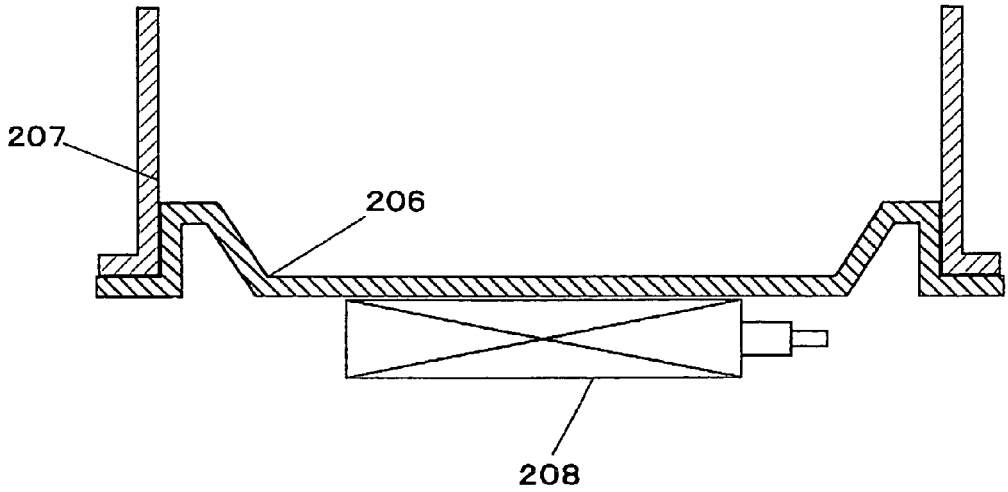
FIG. 24 is a cross-sectional view showing a disadvantage that the heater device is fixed to the evaporation tray (A-A cross-section of FIG. 1), wherein (a) is a cross-sectional view showing a state before the evaporation tray is deformed, and (b) is a cross-sectional view showing a state after the evaporation tray is deformed.
Figure 24:
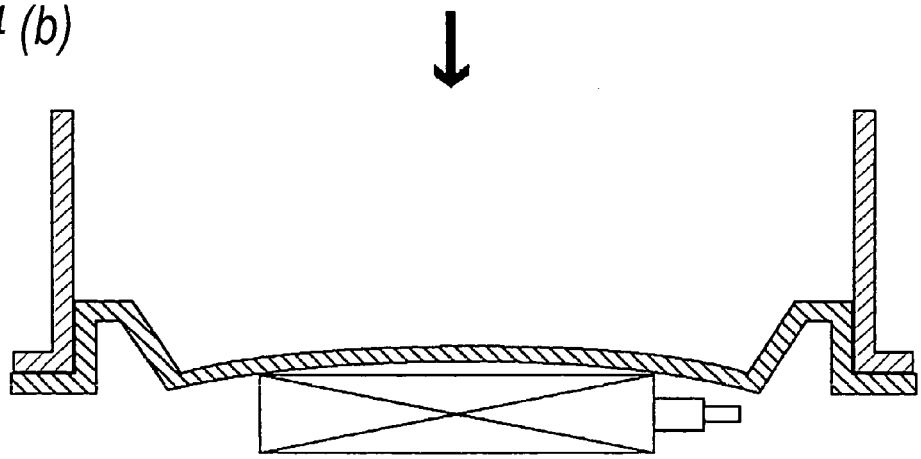
Figure 25:
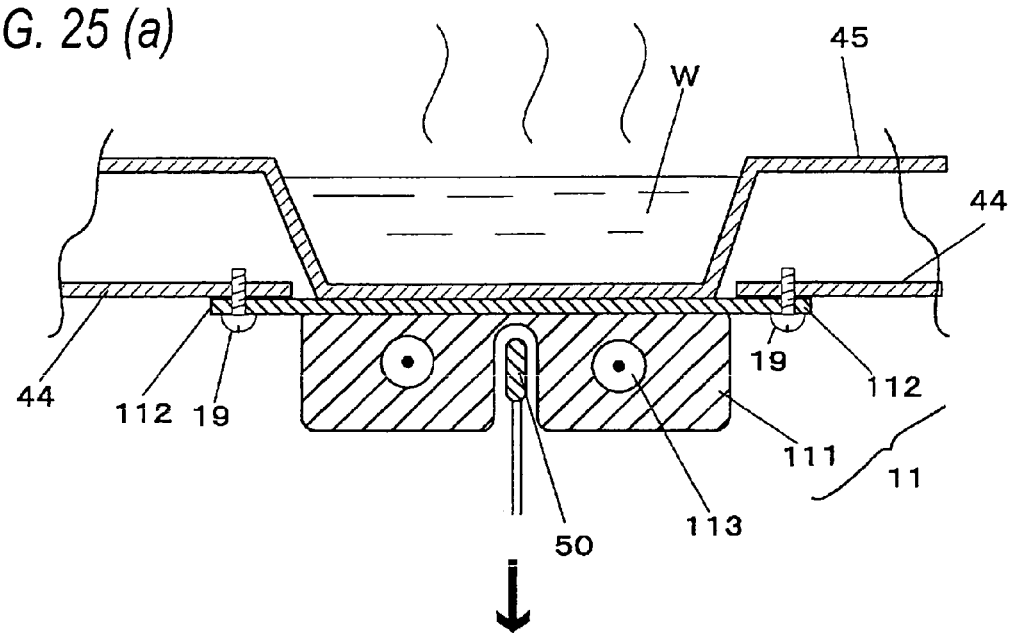
FIG. 25 is a cross-sectional view showing a disadvantage when the heater device is fixed to the evaporation tray (B-B cross-section of FIG. 1), wherein (a) is a cross-sectional view showing a state before the evaporation tray is deformed, and (b) is a cross-sectional view showing a state after the evaporation tray is deformed.
Figure 25:
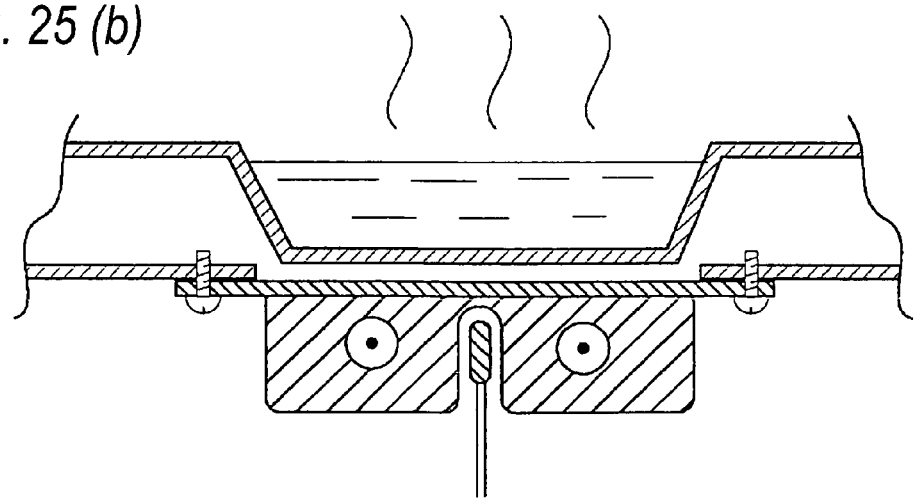

In the first embodiment, as shown in FIGS. 24 and 25, when the heater device is directly fixed to the evaporation tray by a screw, the evaporation tray 206 is deformed by the heat of the heater device 208, and a gap occurs between the heater device 208 and the evaporation tray 206. The evaporation tray 206 and the heater device 206 are brought into closer contact with each other so that no gap occurs, whereby the temperature of the heater device 208 is liable to be thermally conducted to the evaporation tray 206 and thus the steam generation efficiency can be further enhanced. Furthermore, since the temperature of the heater device 208 is not increased more than necessary, and thus steam can be stably generated without setting the current supply of the heater device 108 to OFF by the thermistor.

In the sixth embodiment, the close contact between the evaporation tray and the heater device is further enhanced, thereby providing a high frequency heating apparatus having a steam generation function that can generate steam efficiently and stably.

In (A1) of FIG. 8 showing the first embodiment, 10 represents the housing of the main body of the apparatus, and 11 represents a flat plate type heater device. The flat plate type heater device 11 is achieved by designing into a flat-plate shape a heater device having a U-shaped sheathed heater in an aluminum die cast, and it is characterized in that the flat-plate portion is directly attached to the back side of the evaporation tray formed of a iron plate.

FIG. 9 is an exploded perspective view showing the flat-plate type heater device, wherein (A) is a perspective view showing the evaporation tray, (B1) is a perspective view showing the mount side of the heater device to the evaporation tray, and (B2) is a perspective view showing the back side of the heater device.

In (A), 20 represents a metal evaporation tray. A tray portion is constructed by a side surface 21 and a bottom portion 22 of the tray, and screw holes 23 are formed.

In (B1), 11 represents a heater device formed of aluminum die cast, 111 represents a contact portion to the evaporation tray bottom portion 11, 112 represents a fixing portion, and 113 represents a casted U-shaped sheathed heater. A screw hole 117 and a screw hole 23 of (A) are fixed by screws.

In (B2), the same reference numerals as (B1) represent the same elements and the description thereof is omitted. In this case, it is understood that the sheathed heater 113 is casted in U-shape. Furthermore, two boss portions 11*a*, 11*b* are formed at the back side of the aluminum die cast, and an insertion hole in which a thermistor described later is inserted is formed in the first boss portion 11*a* at the left side of the figure.

Furthermore, a water supply pipe 114 described later is fixed to the second boss portion 11*b* at the right side of the figure.

With this construction, heat generated by the sheathed heater 113 is directly thermally conducted from the contact portion 111 of the aluminum die cast to the evaporation tray 20, so that the thermal conduction is remarkably rapid as compared with the conventional radiation type heating apparatus 15 based on the pipe heater 13 and the reflection plate 14, and thus cooking based on steam can be quickly performed.

Figure 22:
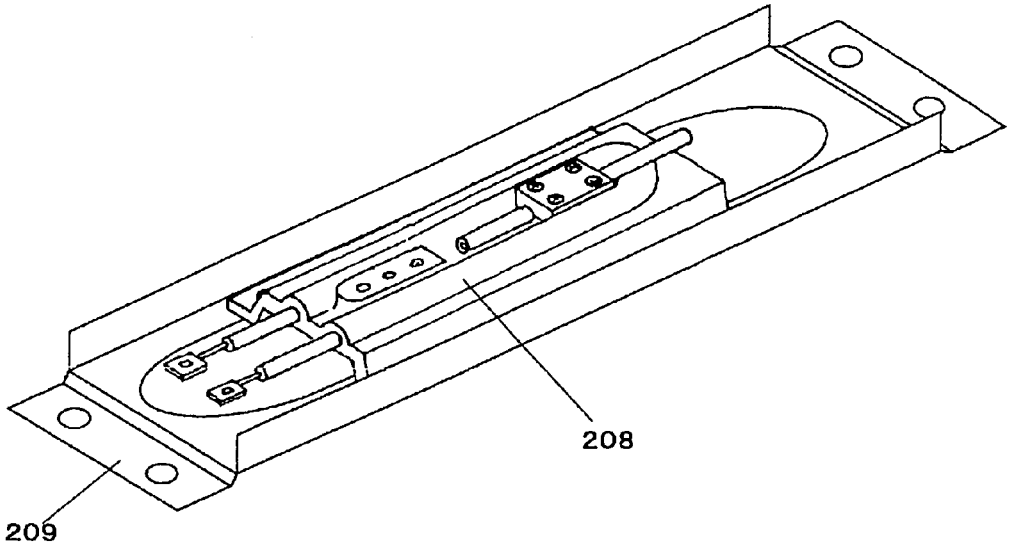
FIG. 22 is a perspective view showing the construction that a holding plate is secured to a planar heater device according to this embodiment.

FIG. 22 is a perspective view showing the flat-plate type heater device of this embodiment to which a holding plate is secured.

Figure 23:
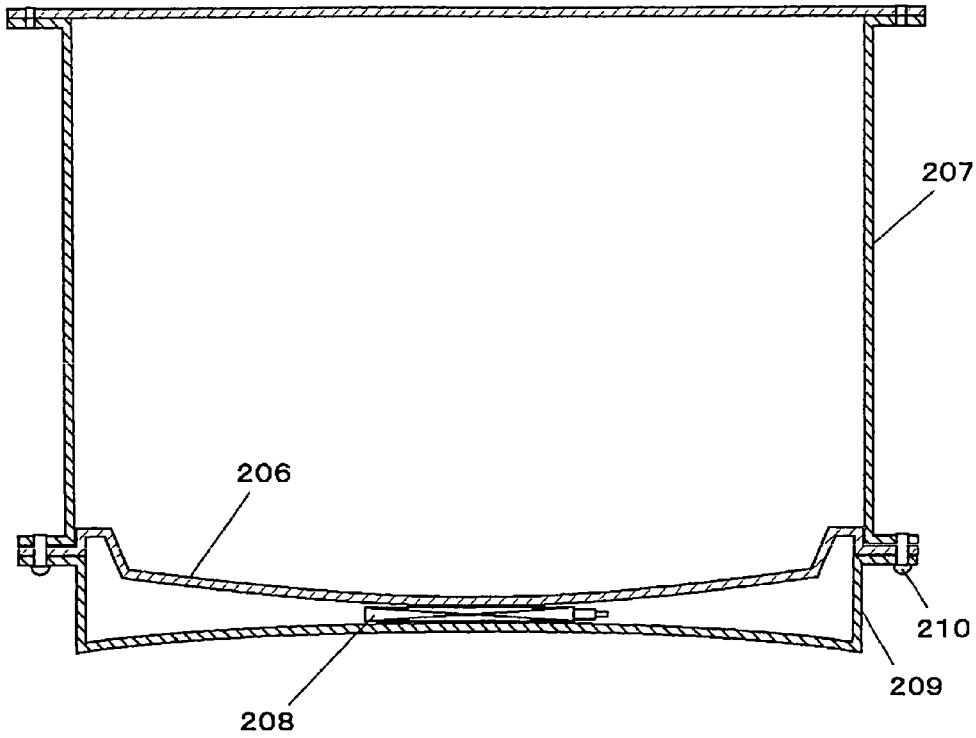
FIG. 23 is a cross-sectional view showing the periphery of the evaporation tray and the heater device according to this embodiment.

In FIG. 22, the holding plate 209 is secured to the heater device 208, and screw-based fixing of engagement-based fixing may be adopted. FIG. 23 is a cross-sectional view showing the periphery of the evaporation tray and the heater device according to the sixth embodiment of the present invention.

In FIG. 23, the evaporation tray 206 is located at the lower side of the rear portion of the heating chamber 207 and designed to be convex-shaped in the longitudinal direction of the heater device 208. The heater device 208 is pressed against the evaporation tray 206 by the holding plate 209. The holding plate 209 is fastened to both the right and left sides of the evaporation tray 206 and the heating chamber 207 by screws 210. The evaporation tray 206 and the heater device 208 are brought into close contact with each other, however, they are not directly and mechanically fixed to each other by screws 210 or the like.

Furthermore, the holding plate 209 is designed to be convex-shaped in the longitudinal direction of the heater device 208 so as to elastically press the heater device 208. Experimentally, it has been found that the height of the convex-shape of the evaporation tray 206/heater device 208 is set to 0.5 mm to 1.5 mm in order to keep the optimal close contact.

Figure 26:
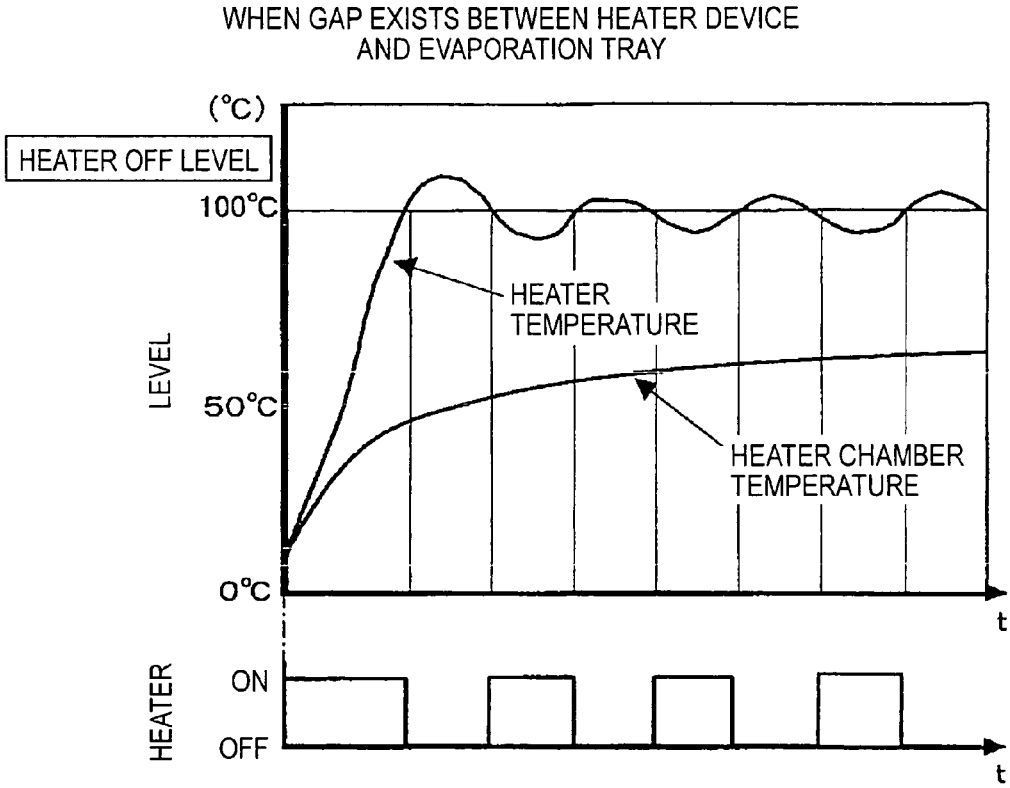
FIG. 26 is a diagram showing the heater temperature and the temperature in the heating chamber under the state that a gap occurs between the heater device and the evaporation tray.

Here, the difference of the temperature in the heating chamber between a case where the evaporation tray 206 and the heater device 208 are brought into close contact with each other and thus there is no gap and a case where they are not brought into close contact with each other and thus there is a gap will be described with reference to FIGS. 26 and 27.

Figure 27:
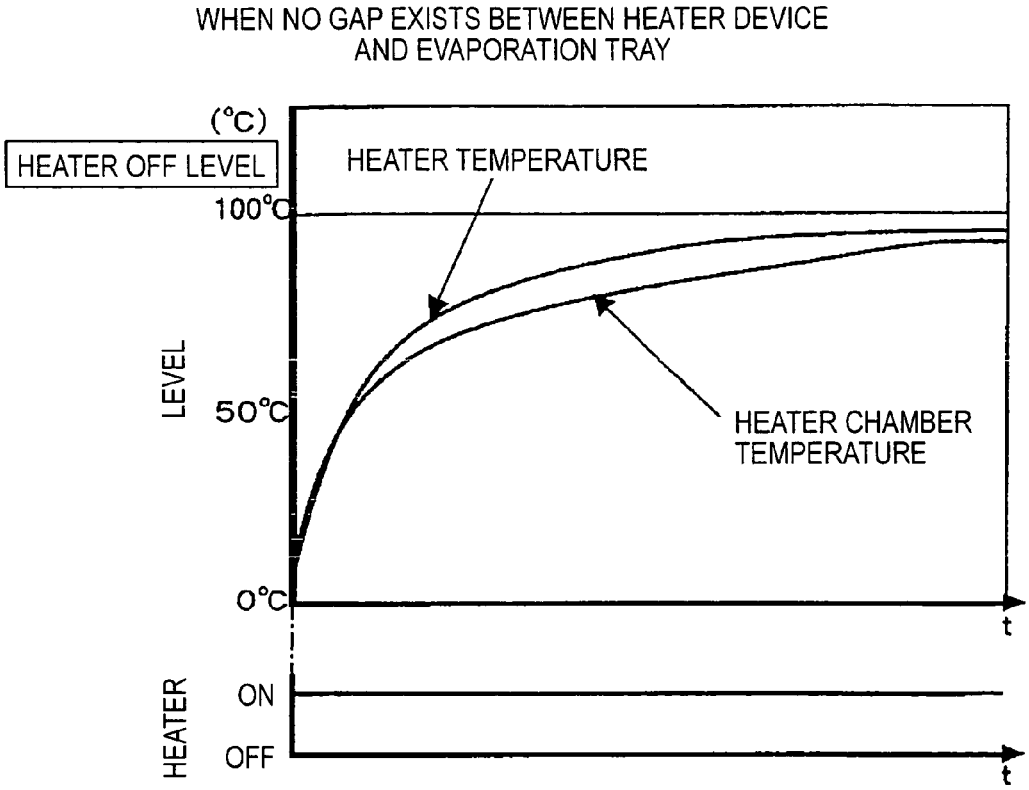
FIG. 27 is a diagram showing the heater temperature and the temperature in the heating chamber under the state that the heater device and the evaporation tray are in close contact with each other.

FIG. 27 is a diagram showing the heater temperature and the temperature in the heating chamber when the heater device 208 and the evaporation tray 208 are under close contact state.

When there is a gap as shown in the graph of FIG. 27, the heat of the heater device 208 cannot be thermally transmitted to the evaporation tray 206 by the gap, and thus the temperature of the heater device 208 itself is increased. Therefore, the heater is set to OFF level to protect the heater, and thus no current is supplied. Accordingly, the temperature of the heating chamber is equal to about 70° C. to 80° C. as shown in the graph, and thus the temperature does not reach the steam-based cooking-possible temperature (the temperature required for egg liquid of pot-steamed hotchpotch to be solidified is equal to 82° C. or more), so that cooking is impossible.

When no gap exists and the heater device 208 and the evaporation tray 206 are brought into close contact with each other as shown in the graph of FIG. 27, the heat of the heater device is thermally transmitted to the evaporation tray 206 and thermally transferred to the water in the evaporation tray 206. Therefore, the temperature of the heater device 208 does not increase to the heater OFF level and it is kept to be supplied with current at all times. Therefore, the water can be efficiently converted to steam and the temperature in the heating chamber is increased to 90° C. or more, so that a sufficient temperature for steam-based cooking can be secured.

The operation and action of the high frequency heating apparatus thus constructed will be described hereunder.

First, the heater device 208 is designed to be pressed against the evaporation tray 206 by the holding plate 209, and even when the evaporation tray 206 is deformed by the heat of the heater device 208, the heater device 208 and the evaporation tray 206 are pressed against each other by the holding plate 209 and thus keep the close contact with each other because the heater device 208 and the evaporation tray 206 are not fixed to each other by screws 210 or the like. Furthermore, the evaporation tray 205 and the holding plate 209 may be designed in convex-shape so as to confront each other, whereby the close contact degree can be enhanced.

As described above, according to this embodiment, in the high frequency heating apparatus having the steam generating function that includes the high frequency generator, the heating chamber 207 in which the heating target is put, the evaporation tray 206, the heater device 208 comprising the sheathed heater embedded in the aluminum die cast for heating the evaporation tray 206, the thermistor disposed in the heater device 208, the steam generator for generating steam in the heating chamber, and the holding plate 209 for holding the heater device 208, the holding plate 209 is disposed so as to press the heater device 208 against the evaporation tray 206 so that the heater device 208 is kept in close contact with the evaporation tray 206 at all times, and thus the heat of the heater device 208 is transmitted to the water on the evaporation tray 206, and the current supply is not set to OFF by the thermistor. Therefore, a stable amount of steam can be provided and steam cooking having the same level as a steam basket can be provided.

The locating positions and number of heater devices with respect to the evaporation tray may be variously considered in accordance with an application of the cooking device. FIG. 11 shows an example thereof.

FIG. 11 shows the locating positions and number of evaporation trays in the high frequency heating apparatus according to the present invention, wherein (a) is a front view showing the state that the opening/closing door of the high frequency heating apparatus is opened, and (b) is a substantially front view showing the locations of the evaporation trays.

In FIG. 11(*a*), 40 represents a high frequency heating apparatus having a steam generating function, 41 represents an upper ceiling of the heating chamber, 42 represents a right side wall, 43 represents, 44 represents a bottom surface, 45 represents a metal plate with evaporation trays, 46R represents a right evaporation tray, 46L represents a left evaporation tray, 47R represents a right water supply port, 47L represents a left water supply port and 49 represents a circulating fan.

The evaporation tray 46 of this invention has large evaporation power, and thus it is not required to be laid so as to cross the back side of a microwave oven like the prior art (see 15 of FIG. 1), and it may be located at one place ((i) of (b)) of the right and left corners of the back side of the microwave oven as shown in FIG. 11(*b*) or at two places of the right and left corners of the back side of the microwave oven as shown in (ii).

In this case, if the evaporation power having the same level as the prior art can be achieved, only one evaporation is sufficient.

When a larger amount of steam is instantaneously needed in accordance with the kind of cooking, it is convenient to provide two evaporation trays. In this case, both the evaporation trays are used, and only one evaporation tray is used when a large amount of steam is not needed, whereby the steam control can be performed. Furthermore, as another method, the heating of one evaporation tray may be stopped or intermittently carried out while the other evaporation tray is continuously heated, thereby carrying out steam adjustment.

As described above, according to the present invention, the heating time can be shortened as compared with the prior art, and the heating time based on electric waves can be shortened. Therefore, the time for which the water of the heating target is evaporated is shortened, so that the decreasing rate of the water of the heating target is reduced.

In addition to the normal temperature control (the control of the steam amount) that the temperature of the heater device (aluminum die cast) is detected by the thermistor embedded at the center portion of the heater and the current supply to the heater is stopped if the detection value exceeds a predetermined value, the control under abnormality when water is wasted on the evaporation tray can be also carried out. As a specific example, the power supply to the heater device is stopped when the thermistor is set to the off-level continuously twice or at a predetermined higher number of times, and the steam heating is stopped. With this construction, the overheat control under abnormality can be rapidly carried out. The overheat protection operation is as follows.

When water is supplied from the water tank and filled on the water supply tray 45, the detection temperature level of the thermistor 50 is increased in connection with the temperature increase of the heating means 113. However, when water is wasted on the water supply tray 45, the current supply is carried out on the heating means, and thus the detection temperature level increases rapidly and exceeds the upper limit reference value.

The control circuit (not shown) interrupts the current supply to the heating means 113 at the time point when the detection temperature level exceeds the upper limit reference value. At this time point, the detection temperature level of the thermistor 50 decreases although some overshoot exists. Finally, at the time point that the detection temperature level of the thermistor 50 reaches the lower limit reference value indicated by c, the control circuit carries out current supply to the heating means 113 to heat the heater. However, since no water exists on the water supply tray 45, the detection temperature level of the thermistor 50 increases again, and exceeds the upper limit reference value indicated by d. At this time point, the control circuit judges that no water exists on the water supply tray 45 and the heating means 113 is under a dry heating state, interrupts the current supply to the heating means 113 as indicated by e, emits an alarm and carries out the control of stopping the steam heating treatment.

In this embodiment, as described above, the generation control of the steam amount and the detection of abnormality when water is wasted on the evaporation tray can be performed by a single thermistor.

Furthermore, through the above-described control, the lifetime of the heater can be increased, the use of the evaporation tray within a heat-resistant temperature is enabled, and deterioration of the fluorine-resin coated surface of the evaporation tray can be prevented.

The mount position of the thermistor is located at the center between the two long axes of the U-shaped sheathed heater 113. In addition, in order to accurately detect the temperature of the evaporation tray 45, a hole 111*a* is formed in the aluminum die cast so as to face the evaporation tray 45, and the thermistor 50 is mounted in the hole 111*a*.

When the siphon-based pumpless system is used, a heater device in which the water supply pipe shown in FIG. 9 is to the aluminum die case may be used.

FIG. 14 is a diagram showing the operation of the siphon-based pumpless system.

In FIG. 14, the steam supply mechanism 91 comprises one water tank 92 which is detachably mounted in the main body 90 of the apparatus, two metal evaporation trays 20 mounted in the heating chamber 93, a heater device 94 for heating each of the metal evaporation trays 20 and evaporating water on the metal evaporation tray 20, a water supply path 95 for leading the water of the water tank 92 through the heating area based on the heater device 94 to the evaporation tray 20, a tank-side waterproof valve 96*a* and a water supply path side waterproof valve 96*b* that are equipped to the connecting portion between the water tank 92 and the water supply path 95 and prevent water leakage in the water tank 92 and the water supply path 95 when the water tank 92 is detached, and a check valve 97 that is disposed at the downstream side of the water supply path side waterproof valve 96*b* and prevents back flow of water from the water supply path 29 to the water tank 92.

The water supply path 95 comprises a base end pipe portion 95*a* connected to the connection port 22*b* of the water tank 92, a horizontal pipe portion 95*b* laid below the bottom plate 98 of the heating chamber 93 so as to pass from the base end wire portion 95*a* through the heating area based on the heater device 94, a vertical pipe portion 95*c* erecting vertically from the tip end of the horizontal pipe portion 95*b* along the side of the heating chamber 93, an upper pipe portion 95*e* extending from the upper end of the vertical pipe portion 95*c* to the upper side of the water supply tray 45 to drop the water fed under pressure from the vertical pipe portion 95*c* onto the water supply tray 45, an air take-in port 95*d* and a water blow-out port 95*f* forming the tip of the upper pipe portion 95*e*.

The horizontal pipe portion 95*b* is laid so as to be brought into contact with the aluminum die cast 94*a* of the heater device 94, and the heat of the heater device 94 is rapidly transmitted. Therefore, the water in the horizontal pipe portion 95*b* is expanded and supplied to the evaporation tray 94.

Here, the principle of generation of steam will be described.

When the heater device 94 generates heat under the state that the water tank 92 is inserted in the tank accommodating portion 35 and water is filled in the horizontal pipe portions 95*b*, 95*b*, heat is transmitted to the water in the pipes at the contact portions, so that the water is expanded.

The check valve 97 temporarily stops the pressure of the expanding water in the pipes, and thus the pressure is directed to the vertical pipe portion 95*c*, so that the expanding water passes through the upper pipe portion 95*e* to be dropped from the water blow-out port 95*f* and supplied onto the evaporation tray 20.

The base pipe portion 95*a* is equipped with the pipe-side waterproof valve 96*b* for preventing water leakage from the horizontal pipe portion 95*b* side when the water tank 92 is detached, and the check valve 47 for preventing back flow from the horizontal pipe portion 95*b* side due to expansion of water in the horizontal pipe portion 95*b* is equipped at the connection portion with the horizontal pipe portion 95*b*.

As shown in FIG. 14, the upper end of the vertical pipe portion 95*c* to which the upper pipe portion 95*e* is connected is located at a position higher than the maximum level position Hmax of the stocked water in the water tank 92. This is to prevent the water stocked in the water tank 92 side form carelessly and continuously flowing out to the upper pipe portion 95*e* by an intercommunicating tube action.

Furthermore, the water supply path 95 is connected to the water tank 92 through the base end pipe portion 95*a* at a position which is further lower than the minimum level Hmin of the stocked water in the water tank 92. This is to enable all the water stocked in the water tank 92 to be taken to the water supply path 95 side.

The water supplied to the evaporation tray 20 is kept to be increased in temperature because of the heat generated by the heater device 94, and thus the time required from the supply of water to the evaporation tray 20 until occurrence of steam can be shortened, and the steam heating can be rapidly performed.

If the heating is interrupted, the water in the vertical pipe portion 95*c* of the water supply path 95 does not expand. Therefore, the water cannot reach the air intake port 9*b*, and the atmospheric pressure invades from the air take-in port 95*d*, so that the water supply is stopped.

Furthermore, in the above construction, when the residual amount of the water tank 92 is equal to 0 (zero) and the residual water amount on the evaporation tray is reduced, the quantity of heat to be consumed by evaporation of water is reduced, and thus the temperature of the heater device 94 and the evaporation tray 20 itself is increased. However, since the steam supply mechanism 91 of this embodiment is equipped with the thermistor 50 for detecting the temperature of the heater device 94 as described above, it is possible to detect the residual amount 0 of the water tank 92 relatively easily by monitoring the detection signal of the thermistor 50, and occurrence of disadvantages such as dry heating, etc. can be prevented.

Furthermore, by using the detection signal of the thermistor, various control operations such as the control operation of stopping the operation of the heater device 94, emitting an alarm for water supply, etc. can be performed when the residual amount 0 of the water tank 92 is detected, and the handling performance of the high frequency heating apparatus 100 can be enhanced.

The foregoing description is applied to the case where one evaporation tray of (i) of (b) of FIG. 11 is provided, and the same principle is applied to a pumpless siphon when two evaporation trays of (ii) are provided. However, in this case, if the water supply paths 95 equipped to the evaporation trays 20 are designed so that the distance from the contact portion of the heater to the water blow-out port of the tip of the pipe is equal between both the water supply paths 95, the supply amounts of the water supply paths 95 can be made coincident with each other, and uniform supply of heating steam in the heating chamber 93 can be implemented in low cost.

As described above, when current is supplied to the sheathed heater, the aluminum die cast is rapidly heated, and the water in the water supply pipe is also rapidly heated to expand. The water thus expanding passes through the atmospheric pressure take-in port 95*d*, and finally reaches the water supply port provided at a position lower than the reference water level, so that the siphon operation is started and the water from the water tank is supplied from the water supply port at the tip of the water supply pipe onto the evaporation tray. The water supply is continued while heating is carried out. When the heating is interrupted, the water in the water supply pipe does not expand. Accordingly, the water does not reach the air take-in port 95*d*, and the atmospheric pressure enters from the air take-in port 95*d* into the pipe and the water supply is stopped.

As described above, if the heater device according to the present invention shown in FIG. 9 or 10 is used, rapid high-temperature heating can be performed, and the water in the water supply pipe can rapidly and greatly expand, so that the pumpless driving using the siphon can be first performed.

The present invention has been described in detail by referring to the specific embodiments, however, it is obvious to the persons skilled in the art that various modifications and alterations may be applied to the embodiments without departing from the spirit and scope of the present invention.

This application is based on Japanese Patent Application No. 2003-068222 filed on Mar. 13, 2003, Japanese Patent Application No. 2003-143014 filed on May 21, 2003 and Japanese Patent Application No. 2003-288780 filed on Aug. 7, 2003, and the contents thereof are taken in here as reference.

INDUSTRIAL APPLICABILITY

As described above, according to the high frequency heating apparatus having the steam generating function, in the high frequency heating apparatus having the steam generating function equipped with the high frequency wave generator, and a steam generator including an evaporation tray provided to the bottom surface of the heating chamber for accommodating a heating target and a heater device for heating the evaporation tray to generate steam in the heating chamber, the heater device is achieved by embedding a sheathed heater in an aluminum die cast, and the heater device is directly attached to the back side of the evaporation tray. Therefore, the speed from the drop of water until the water thus dropped is evaporated can be remarkably increased with the same watt value as the conventional device and the prior invention.

Furthermore, according to the high frequency heating apparatus having the steam generating function, in the high frequency heating apparatus having the steam generating function equipped with the high frequency wave generator, and the steam generator that comprises the evaporation tray support opening portion provided on the bottom surface of the heating chamber for accommodating the heating target and the heater device closing the evaporation tray support opening portion and generates steam in the heating chamber, the heater device is designed as a heater device achieved by setting the upper surface of the aluminum die case as an evaporation tray and embedding the sheathed heater in the lower surface of the aluminum die cast, and the heater device is mounted in the evaporation tray support opening portion so that the evaporation tray of the heater device faces the evaporation tray support opening portion, and water is heated at higher speed.

Furthermore, according to the high frequency heating apparatus having the steam generating function of the present invention, the metal seal is provided between the evaporation tray support opening portion and the heater device. Therefore, the electric wave leakage of microwaves which may leak from the gap between the evaporation tray support opening portion and the heater device can be perfectly prevented.

Furthermore, according to the high frequency heating apparatus having the steam generating function of the present invention, the thermistor is disposed in the aluminum die cast, and the control of the evaporation amount and the control under abnormality when water is wasted on the evaporation tray are carried out on the basis of temperature information from the thermistor. Therefore, the control of the evaporation amount and the overheat control under abnormality can be carried with a simple construction.

According to the high frequency heating apparatus having the steam generating function, when the thermistor is set to off-level continuously twice or at a predetermined higher number of times, the power supply to the heater device is stopped, and the steam heating is stopped. Therefore, the overheat control under abnormality can be rapidly carried out.

Furthermore, according to the high frequency heating apparatus having the steam generating function, the heater device is constructed by embedding the sheathed heater in the aluminum die cast in U-shape, and the thermistor is mounted in the hole between the two long axes of the U-shape concerned. Therefore, the thermistor can accurately detect the temperature in the neighborhood of the evaporation tray.

According to the high frequency heating device having the steam generating function of the present invention, the steam generator is provided at one side or both the sides of the back portion opposite to the heating target take-out port of the heating chamber. Therefore, the steam generator does not obstruct cooking and there is no burn injury risk. Furthermore, the steam control can be more easily performed by disposing a higher number of steam generators.

Furthermore, according to the high frequency heating device having the steam generating function of the present invention, the water supply pipe is fixed to the aluminum die cast. Therefore, the siphon-based pumpless water supply to the evaporation tray can be carried out by heating the water in the water supply pipe.

Still furthermore, according to the high frequency heating apparatus having the steam generating function of the present invention, the water pipe is used as a part of the water supply pipe line for supplying a predetermined amount of water from the water tank to the evaporation tray, and the atmospheric pressure take-in port is provided at some midpoint of the water supply pipe directing from the water supply pipe to the evaporation tray. Water in the water supply pipe is rapidly heated and expanded, whereby the expanding water passes through the air take-in port, and starts the siphon function. Therefore, no water feeding pump is needed, and the present invention contributes to reduction of the number of parts and saving of energy.

According to the high frequency heating apparatus having the steam generating function the sheathed heater is shaped to be bent substantially U-shape, and thus even in the case of a steam supply mechanism having a relatively large output, it can be miniaturized, and there can be prevented occurrence of such heating unevenness that there occurs both a place supplied with water and a place supplied with no water. The water supplied to the water supply tray is dropped and supplied onto the water supply tray at the bent site of the substantially U-shaped sheathed heater at which the temperature is increased to a relatively high value. Therefore, the time required from the water supply to the water supply tray till occurrence of steam can be shortened, and rapid steam heating can be performed.

According to the high frequency heating apparatus having the steam generating function of the present invention, when the residual amount of the water tank is equal to 0 (zero) and the residual water amount on the water supply tray is reduced, the quantity of amount to be consumed by the evaporation of water is reduced, and thus the heating means and the water supply tray itself are increased in temperature. The center portion of the sheathed heater which is bent and shaped substantially U-shape is the place at which the temperature is increased to the highest value, and thus it is easier to grasp the variation of the temperature increase at this place. Therefore, if a temperature sensor is provided at this place, the residual amount zero of the water tank can be relatively simply detected by monitoring the detection signal of the temperature sensor.

Furthermore, according to the high frequency heating apparatus having the steam generating function, the slit is provided at the outer peripheral portion of the temperature detecting sensor disposed at the center portion of the sheathed heater, whereby the block temperature in the neighborhood of the temperature detecting sensor is hardly affected by the temperature of the sheathed heater adjacent thereto, and thus the presence or absence of water on the water supply tray can be more accurately detected.

Still furthermore, according to the high frequency heating apparatus having the steam generating function of the present invention, the material having high thermal conductivity and flexibility is sandwiched between the aluminum die cast block serving as the heating means and the water supply tray, whereby the air layer caused by minute unevenness can be eliminated. Therefore, the heat transmission efficiency can be enhanced, and there can be provided a steam supply mechanism in which the temperature detection can be accurately performed without loss.

Still furthermore, according to the high frequency heating apparatus having the steam generating function of the present invention, the temperature detecting sensor is inserted together with the material having high thermal conductivity and flexibility in the hole provided in the assembly block, whereby there can be provided a steam supply mechanism having high response to the temperature detection.

According to the high frequency heating apparatus having the steam generating function of the present invention, the heater device is kept in close contact with the evaporation tray at all times, and the heat of the heater device is transmitted to the water on the evaporation tray. Therefore, the current supply is prevented from being set to OFF by the thermistor. Accordingly, the stable steam amount can be provided.

Furthermore, according to the high frequency heating apparatus having the steam generating function of the present invention, the heater device achieved by embedding the sheathed heater in the aluminum die cast is pressed against the back side of the evaporation tray, where the close contact can be kept excellent at all times, and the heat transmission can be enhanced. Accordingly, even in the case of the same watt value, the speed from the dropping of water until evaporation of the dropped water can be remarkably increased.

According to the high frequency heating apparatus having the steam generating function of the present invention, the steam amount can be made stable, and thus a steam heating system suitable for a heating target can be easily implemented. Therefore, the present invention is applicable to a heating device for carrying out a heating treatment on a heating target in combination with steam heating.

The invention claimed is:

1. A high frequency heating apparatus having a steam generating function comprising:

a heating chamber which accommodates a heating target mounted therein;

a high frequency wave generator;

a water supply pipe; and a steam generator comprising:

an evaporation tray provided at the bottom surface of the heating chamber and located at one or both sides of a back side opposite to a heating target take-out port of the heating chamber; and a heater device for heating the evaporation tray, wherein the steam generator generates steam in the heating chamber, wherein the heater device comprises a substantially sheathed heater embedded in an aluminum die cast, and the heater device is directly attached to the back side of the evaporation tray and wherein the water supply pipe is fixed to the aluminum die cast.

2. The high frequency heating apparatus having the steam generating function according to claim 1, wherein a thermistor is provided to the aluminum die cast, and the control of the amount of evaporation from the evaporation tray and the control under abnormality when water on the evaporation tray is wasted are performed on the basis of temperature information from the thermistor.

3. The high frequency heating apparatus having the steam generating function according to claim 1, wherein the power supply to the heating apparatus is stopped and steam heating is stopped when the thermistor is set to off-level sequentially twice or at a predetermined higher number of times.

4. The high frequency heating apparatus having the steam generating function according to claim 1, wherein the heater device is substantially U-shaped wherein the sheathed heater is embedded in the aluminum die cast corresponding to the U-shaped heater device, and a thermistor is mounted in a hole formed between the two long axes of the U-shape concerned.

5. The high frequency heating apparatus having the steam generating function according to claim 1, wherein the steam generator is provided to one or both sides of the back side opposite to the heating target take-out port of the heating chamber.

6. A high frequency heating apparatus having a steam generating function, wherein the water supply pipe according to claim 1 is used as a part of a water supply pipe line for supplying a predetermined amount of water from a water tank to a predetermined amount of water, atmospheric pressure take-in port is provided at some midpoint of the water supply pipe line directing to from the water supply pipe to the evaporation tray, water is expanded by rapidly heating the water in the water supply pipe, and the expanded water is passed through the air take-in port to start a siphon function.

7. The high frequency heating apparatus having the steam generating function according to claim 1, further comprising a holding plate for holding the heater device, wherein the holding plate is disposed to be pressed against the back side of the evaporation tray of the heater device.

8. The high frequency heating apparatus having the steam generating function according to claim 7, wherein the holding plate is not fastened to the evaporation tray by a screw.

9. The high frequency heating apparatus having the steam generating function according to claim 7, wherein the evaporation tray is designed to have a convex shape in the longitudinal direction of the heater device.

10. The high frequency heating apparatus having the steam generating function according to claim 7, wherein the holding plate is designed to have a convex shape in the longitudinal direction of the heater device.

11. A high frequency heating apparatus having a steam generating function comprising:

a heating chamber which accommodates a heating target mounted therein;

a high frequency wave generator; and a steam generator that comprises an evaporation tray supporting opening portion provided at the bottom surface of the heating chamber, and a heater device closing the evaporation tray supporting opening portion, and that generates steam in the heating chamber, wherein the heater device comprises a substantially sheathed heater and an aluminum die cast having a lower surface and an upper surface, whereby the upper surface of the aluminum die cast serves as an evaporation tray and the sheathed heater is embedded in a lower surface of the aluminum die cast, and the heater device is secured to the evaporation tray supporting opening portion so that the evaporation tray of the heater device is located at one or both sides of a back side opposite to a heating target take-out port of the heating chamber and faces the evaporation tray supporting opening portion and wherein the heater device is constructed by embedding the sheathed heater in the aluminum die case in U-shape, and a thermistor is mounted in a hole formed between the two long axes of the U-shape concerned.

12. The high frequency heating apparatus having the steam generating function according to claim 11, wherein a metal seal is provided between the evaporation tray supporting opening portion and the heater device.

13. The high frequency heating apparatus having the steam generating function according to claim 11, wherein a thermistor is provided to the aluminum die cast, and the control of the amount of evaporation from the evaporation tray and the control under abnormality when water on the evaporation tray is wasted are performed on the basis of temperature information from the thermistor.

14. The high frequency heating apparatus having the steam generating function according to claim 11, wherein the power supply to the heating apparatus is stopped and steam heating is stopped when the thermistor is set to off-level sequentially twice or at a predetermined higher number of times.

15. The high frequency heating apparatus having the steam generating function according to claim 11, wherein the steam generator is provided to one or both sides of the back side opposite to the heating target take-out port of the heating chamber.

16. The high frequency heating apparatus having the steam generating function according to claim 11, wherein a water supply pipe is fixed to the aluminum die cast.

17. A high frequency heating apparatus having a steam generating function, wherein the water supply pipe according to claim 16 is used as a part of a water supply pipe line for supplying a predetermined amount of water from a water tank to a predetermined amount of water, atmospheric pressure take-in port is provided at some midpoint of the water supply pipe line directing to from the water supply pipe to the evaporation tray, water is expanded by rapidly heating the water in the water supply pipe, and the expanded water is passed through the air take-in port to start a siphon function.

18. A high frequency heating apparatus having a steam generating function comprising:

high frequency wave generating means for outputting high frequency waves into a heating chamber in which a heating target is accommodated; and a steam supply mechanism for supplying heating steam into the heating chamber, at least one of the high frequency waves and the heating steam being supplied to the heating chamber to carry out a heating treatment on the heating target, wherein the steam supply mechanism comprises a water tank detachably secured to the main body of the apparatus, a water supply tray mounted in the heating chamber, and heating means for heating the water supply tray to evaporate water on the water supply tray, wherein the heating means has a sheathed heater formed so as to be bent in a substantially U-shape and water is dropped onto the surface of the water supply tray above the bent site of the sheathed heater and wherein the steam supply mechanism has a material having high thermal conductivity and flexibility sandwiched between the heating means and the water supply tray to fix the heating means and the water supply tray to each other in close contact.

19. The high frequency heating apparatus having the steam generating function according to claim 18, wherein the steam supply mechanism is equipped with a temperature detecting sensor for detecting the temperature of the heating means or the water supply tray, and the temperature detecting sensor is disposed at the center portion of the sheathed heater which is formed so as to be bent in the substantially U-shape.

20. The high frequency heating apparatus having the steam generating function according to claim 19, wherein the steam supply mechanism is designed so that a slit is provided at the outer peripheral portion of the temperature detecting sensor disposed at the center portion of the sheathed heater which is formed so as to be bent substantially in U-shape.

21. The high frequency heating apparatus having the steam generating function according to claim 18, wherein the steam supply mechanism has a temperature detecting sensor that is inserted and fixed together with material having high thermal conductivity in a hole formed in the heating means of the assembly block of the aluminum die cast.

22. A high frequency heating apparatus having a steam generating function comprising:

high frequency wave generating means for outputting high frequency waves into a heating chamber in which a heating target is accommodated; and a steam supply mechanism for supplying heating steam into the heating chamber, at least one of the high frequency waves and the heating steam being supplied to the heating chamber to carry out a heating treatment on the heating target, wherein the steam supply mechanism comprises a water tank detachably secured to the main body of the apparatus, a water supply tray mounted in the heating chamber, heating means for heating the water supply tray to evaporate water on the water supply tray, a water supply path for introducing water in the water tank through a heating area based on the heating means to the water supply tray, and a water supply nozzle for supplying water on the water supply tray, wherein the heating means is formed by disposing a sheathed heater bent in a substantially U-shape in an assembly block of aluminum die cast, and the nozzle tip of the water supply nozzle is disposed in the neighborhood of the bent site of the sheathed heater and wherein the steam supply mechanism further comprises a material having high thermal conductivity and flexibility sandwiched between the heating means and the water supply tray to fix the heating means and the water supply tray to each other in close contact.

23. The high frequency heating apparatus having the steam generating function according to claim 22, wherein the steam supply mechanism is equipped with a temperature detecting sensor for detecting the temperature of the heating means or the water supply tray, and the temperature detecting sensor is disposed at the center portion of the sheathed heater which is formed so as to be bent in the substantially U-shape.

24. The high frequency heating apparatus having the steam generating function according to claim 23, wherein the steam supply mechanism is designed so that a slit is provided at the outer peripheral portion of the temperature detecting sensor disposed at the center portion of the sheathed heater which is formed so as to be bent substantially in U-shape.

25. The high frequency heating apparatus having the steam generating function according to claim 22, wherein the steam supply mechanism has a temperature detecting sensor that is inserted and fixed together with material having high thermal conductivity in a hole formed in the heating means of the assembly block of the aluminum die cast.

* * * * *

UNITED STATES PATENT AND TRADEMARK OFFICE

CERTIFICATE OF CORRECTION

PATENT NO. : 7,304,278 B2
APPLICATION NO. : 10/548479
DATED : December 4, 2007
INVENTOR(S) : Kouji Kanzaki et al.

It is certified that error appears in the above-identified patent and that said Letters Patent is hereby corrected as shown below:

In column 16, line 17, please delete the word "hater" and insert therefor --heater--.

In column 17, line 4, please delete "11a" and insert therefor --111a--.

Signed and Sealed this

Eighteenth Day of November, 2008

JON W. DUDAS
*Director of the United States Patent and Trademark Office*